US011610541B1

(12) United States Patent
Kim et al.

(10) Patent No.: US 11,610,541 B1
(45) Date of Patent: Mar. 21, 2023

(54) PIXEL OF DISPLAY DEVICE

(71) Applicant: SAMSUNG DISPLAY CO., LTD., Yongin-si (KR)

(72) Inventors: Jay Bum Kim, Yongin-si (KR); Myeong Ho Kim, Yongin-si (KR); Kyoung Seok Son, Yongin-si (KR); Seung Jun Lee, Yongin-si (KR); Seung Hun Lee, Yongin-si (KR); Jun Hyung Lim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/810,031

(22) Filed: Jun. 30, 2022

(30) Foreign Application Priority Data

Sep. 30, 2021 (KR) ..... 10-2021-0130180

(51) Int. Cl.
*G09G 3/32* (2016.01)

(52) U.S. Cl.
CPC ..... *G09G 3/32* (2013.01); *G09G 2300/0426* (2013.01); *G09G 2300/0852* (2013.01); *G09G 2310/0267* (2013.01); *G09G 2320/0247* (2013.01)

(58) Field of Classification Search
CPC ..... G09G 3/32; G09G 2300/0426; G09G 2300/0852; G09G 2310/0267; G09G 2320/0247
See application file for complete search history.

(56) References Cited

U.S. PATENT DOCUMENTS

| | | | | |
|---|---|---|---|---|
| 11,056,049 | B2 | 7/2021 | Kim et al. | |
| 2019/0385523 | A1* | 12/2019 | Na | G09G 3/3291 |
| 2020/0043404 | A1* | 2/2020 | Yu | G09G 3/32 |
| 2021/0142719 | A1* | 5/2021 | Qin | G09G 3/3291 |
| 2021/0248961 | A1 | 8/2021 | Yang et al. | |
| 2021/0272521 | A1 | 9/2021 | Yoon et al. | |

FOREIGN PATENT DOCUMENTS

| | | |
|---|---|---|
| KR | 10-2020-0000513 | 1/2020 |
| KR | 10-2021-0013509 | 2/2021 |
| KR | 10-2021-0100785 | 8/2021 |

* cited by examiner

*Primary Examiner* — Andrew Sasinowski
(74) *Attorney, Agent, or Firm* — F. Chau & Associates, LLC

(57) ABSTRACT

A pixel includes a light emitting element, first through third transistors, sixth through seventh transistors, a ninth transistor, and a capacitor. The first transistor is connected between supply and a second node and controls a driving current supplied to the light emitting element. The second transistor is connected between a third node and a data line. The third transistor is connected between a first node connected to a gate electrode of the first transistor and the second node. The sixth transistor is connected between the supply and a fifth node connected to an electrode of the first transistor. The seventh transistor is connected between the second node and a fourth node connected to an anode of the light emitting element. The ninth transistor is connected between the fifth node and bias. Gate electrodes of the sixth through seventh transistors and the ninth transistor are connected to a same emission line.

21 Claims, 18 Drawing Sheets

PIXEL OF DISPLAY DEVICE

CROSS-REFERENCE TO RELATED APPLICATION

This U.S. non-provisional patent application claims priority under 35 U.S.C. § 119 to Korean Patent Application No. 10-2021-0130180, filed in the Korean Intellectual Property Office on Sep. 30, 2021, the disclosure of which is incorporated by reference herein.

1. TECHNICAL FIELD

The disclosure relates to a pixel of a display device.

2. DISCUSSION OF RELATED ART

A display device includes a plurality of pixels. Each of the pixels includes a plurality of transistors, and a light emitting element and a capacitor electrically connected to the transistors. The transistors are respectively turned on in response to signals provided through a line, and thus a predetermined driving current is generated. The light emitting element emits light in response to such a driving current.

A varying driving frequency may be used to drive the display device to improve driving efficiency and minimize power consumption. A method of separately driving a threshold voltage compensation period and a data writing period of a driving transistor included in each pixel may be used for high-speed driving.

However, such a driving method may cause issues such as flicker phenomenon and image quality unevenness when the driving frequency is changed.

SUMMARY

When the power supplied to a pixel circuit and a number of transistors of the pixel circuit increases, it may be difficult to implement a high-resolution display. Further, the number of scan drivers may increase due to the increased number of transistors, and thus a non-display area (or a bezel area) of a display panel of the display may increase.

An object of the disclosure is to provide a display device including a pixel capable of providing a high resolution while preventing a flicker phenomenon when a driving frequency is varied.

In an embodiment of the disclosure, the pixel of the display device includes a light emitting element, first to third transistors, sixth to seventh transistors, a ninth transistor, and a capacitor. The first transistor includes a gate electrode connected to a first node. The first transistor is connected between first power and a second node and is controls a driving current supplied to the light emitting element. The first capacitor includes one electrode connected to the first node and another electrode connected to a third node. The second transistor is connected between the third node and a data line. The third transistor is connected between the first node and the second node. The sixth transistor is connected between the first power and a fifth node connected to one electrode of the first transistor. The seventh transistor is connected between the second node and a fourth node connected to the light emitting element. The ninth transistor is connected between the fifth node and bias power. Gate electrodes of each of the sixth transistor, the seventh transistor, and the ninth transistor are connected to a same emission control line.

The pixel may further include an eighth transistor connected between the fourth node and anode initialization power, and a gate electrode of the eighth transistor may be connected to the emission control line.

The sixth transistor and the seventh transistor may be P-type thin film transistors, and the eighth transistor and the ninth transistor may be N-type thin film transistors.

The pixel may further include a fourth transistor connected between the first node and initialization power, and a fifth transistor connected between reference power and the third node.

The second transistor, the third transistor, the fourth transistor, the fifth transistor, the eighth transistor, and the ninth transistor may be N-type thin film transistors.

The second transistor may be turned on by a first scan signal, the third transistor may be turned on by a second scan signal, the fourth transistor may be turned on by a third scan signal, the fifth transistor may be turned on by the second scan signal, the sixth transistor may be turned off by an emission control signal, the seventh transistor may be turned off by the emission control signal, the eighth transistor may be turned on by the emission control signal, and the ninth transistor may be turned on by the emission control signal.

The pixel may further include a second capacitor including one electrode connected to the first power and another electrode connected to the third node.

The pixel may further include a fourth transistor connected between the first node and initialization power, and a fifth transistor connected between the first power and the third node.

The pixel may further include an eighth transistor connected between the fourth node and the initialization power, and a gate electrode of the eighth transistor may be connected to the emission control line.

The pixel may further include a fourth transistor connected between the first node and initialization power, a fifth transistor connected between reference power and the third node, and an eighth transistor connected between the fourth node and the initialization power, and a gate electrode of the eighth transistor may be connected to the emission control line.

The third scan signal, the second scan signal, and the first scan signal may be sequentially provided during a period in which the emission control signal is supplied.

When the eighth transistor is turned on by the emission control signal, a voltage of the anode initialization power may be supplied to the fourth node, and when the ninth transistor is turned on by the emission control signal, a voltage of the bias power may be supplied to the fifth node.

When the fourth transistor is turned on by the third scan signal, a voltage of the initialization power may be supplied to the first node.

When the third transistor is turned on by the second scan signal, the first transistor may be diode connected.

When the ninth transistor is turned on by the emission control signal, a voltage of the first node may be a difference value between a voltage of the bias power and a threshold voltage of the first transistor.

When the second transistor is turned on by the first scan signal, a data signal may be provided from the data line to the third node.

The pixel may further include a fourth transistor connected between the first node and initialization power and a fifth transistor connected between the bias power and the third node.

The pixel of the display device according to an embodiment of the disclosure may configure a pixel circuit to include an N-type transistor and a P-type transistor, and integrally control some transistors with the emission control signal instead of a scan signal. Therefore, a flicker phenomenon may be prevented when a driving frequency is varied, and high resolution may be implemented.

In an embodiment of the disclosure, a pixel of the display device includes a light emitting element, first to third transistors, fifth to seventh transistors, and a ninth transistor. The first transistor includes a gate electrode connected to a first node. The first transistor is connected between first power and a second node and controls driving current supplied to the light emitting element. The second transistor is connected between a third node and a data line. The third transistor is connected between the first node and the second node. The fifth transistor is connected between the bias power and the third node. The sixth transistor is connected between the first power and a fifth node connected to one electrode of the first transistor. The seventh transistor is connected between the second node and a fourth node connected to the light emitting element. The ninth transistor is connected between the fifth node and bias power. Gate electrodes of each of the sixth transistor, the seventh transistor, and the ninth transistor are connected to a same emission control line. The third and fifth transistors may be controlled by a same scan signal.

In an embodiment of the disclosure, a pixel of the display device includes a light emitting element, first to fourth transistors and sixth to ninth transistors. The first transistor includes a gate electrode connected to a first node. The first transistor is connected between first power and a second node and controls a driving current supplied to the light emitting element. The second transistor is connected between a third node and a data line. The third transistor is connected between the first node and the second node. The fourth transistor is connected between the first node and initialization power. The sixth transistor is connected between the first power and a fifth node connected to one electrode of the first transistor. The seventh transistor is connected between the second node and a fourth node connected to the light emitting element. The eighth transistor is connected between the fourth node and the initialization power. The ninth transistor connected between the fifth node and bias power. Gate electrodes of each of the sixth through ninth transistors are connected to a same emission control line. In an embodiment, the sixth and seventh transistors are transistors of a complementary type different from the eighth and ninth transistors.

BRIEF DESCRIPTION OF THE DRAWINGS

The above and other features of the disclosure will become more apparent by describing in further detail embodiments thereof with reference to the accompanying drawings, in which.

DETAILED DESCRIPTION OF THE EMBODIMENTS

Figure 1:
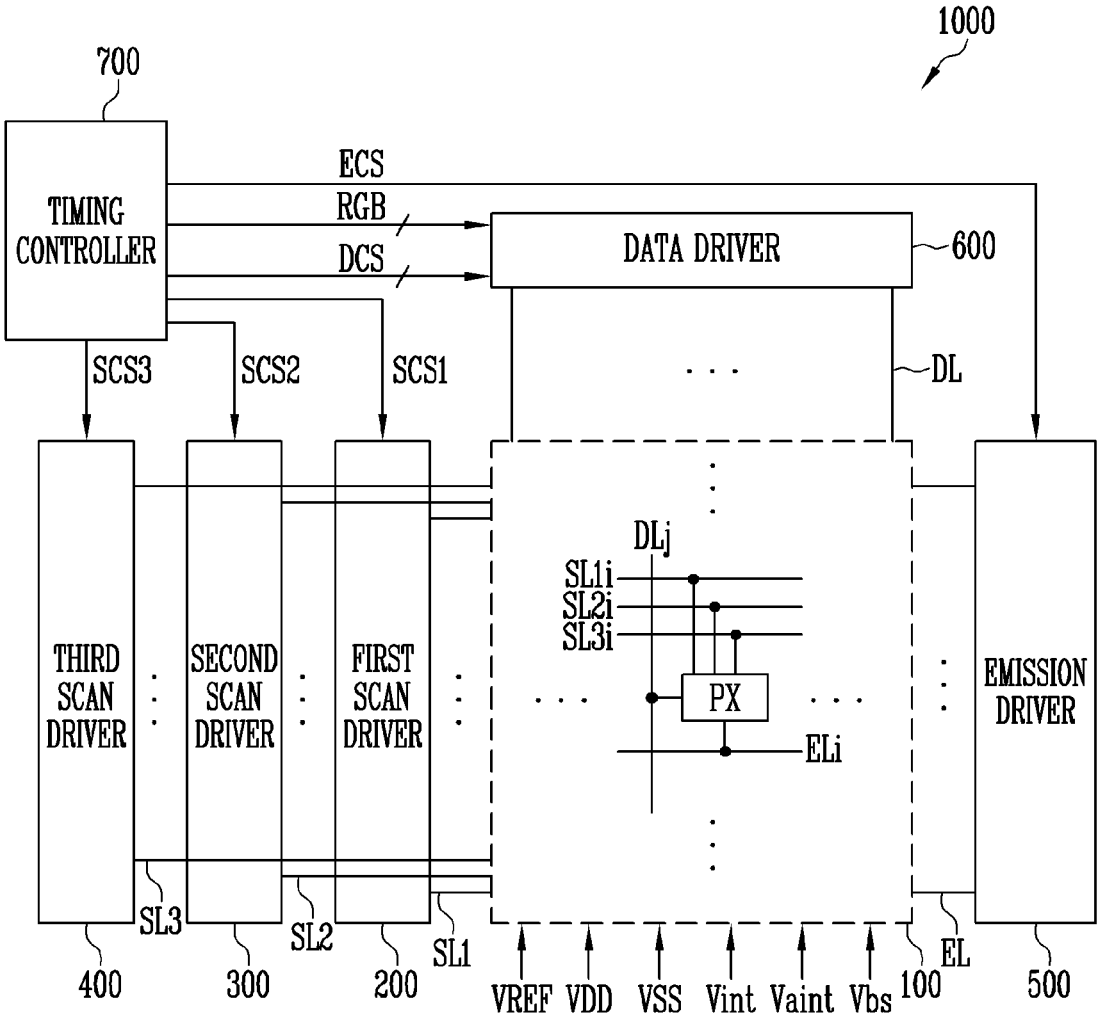
FIG. 1 is a block diagram illustrating a display device according to an embodiment of the disclosure.

The disclosure may be modified in various manners and have various forms. Therefore, specific embodiments will be illustrated in the drawings and will be described in detail in the specification. However, it should be understood that the disclosure is not intended to be limited to the disclosed specific forms, and the disclosure includes all modifications, equivalents, and substitutions within the spirit and technical scope of the disclosure.

Similar reference numerals are used for similar components in describing each drawing. In the accompanying drawings, the dimensions of the structures shown may differ in size from the actual dimensions for the sake of clarity of the disclosure. Terms of "first", "second", and the like may be used to describe various components, but the components should not be limited by the terms. The terms are used only for the purpose of distinguishing one component from another component. For example, without departing from the scope of the disclosure, a first component may be referred to as a second component, and similarly, a second component may also be referred to as a first component. The singular expressions include plural expressions unless the context clearly indicates otherwise.

It should be understood that in the present application, a term of "include", "have", or the like is used to specify that there is a feature, a number, a step, an operation, a component, a part, or a combination thereof described in the specification, but does not exclude a possibility of the presence or addition of one or more other features, numbers, steps, operations, components, parts, or combinations thereof in advance.

In addition, a case where a portion is "connected" to another portion, the case includes not only a case where the portion is directly connected to the other portion but also a case where the portion is connected to the other portion with another element interposed therebetween.

Hereinafter, embodiments of the disclosure are described in more detail with reference to the accompanying drawings.

FIG. 1 is a block diagram illustrating a display device according to an embodiment of the disclosure.

Referring to FIG. 1, the display device 1000 may include a display panel 100, scan drivers 200, 300, and 400 (e.g., driver circuits), an emission driver 500 (e.g., a driver circuit), a data driver 600 (e.g., driver circuit), and a timing controller 700 (e.g., a control circuit).

The scan driver 200, 300, and 400 may be divided into configurations and operations of a first scan driver 200, a second scan driver 300, and a third scan driver 400. However, the division of the scan drivers 200, 300, and 400 is for convenience of description, and at least a portion of the scan drivers 200, 300, and 400 may be integrated into one driving circuit, module, or the like according to design.

In an embodiment, the display device 1000 may further include a power supply, which is not shown, to supply voltages of first power VDD, second power VSS, third power VREF (or reference power), fourth power Vint (or initialization power), fifth power Vaint (or anode initialization power), and sixth power Vbs (or bias power) to the display panel 100.

The power supply may supply low power and high power determining a gate-on level and a gate-off level of a scan signal, a control signal, and/or an emission control signal to the scan drivers 200, 300, and 400, and/or to the emission driver 500. The low power may have a voltage level lower than that of the high power. However, this is an example, and at least one of the first power VDD, the second power VSS, the third power VREF (or the reference power), the fourth power Vint (or the initialization power), the fifth power Vaint (or the anode initialization power), the sixth power Vbs (or the bias power), the low power, and the high power may be supplied from the timing controller 700 or the data driver 600.

According to an embodiment, the first power VDD and the second power VSS may generate voltages for driving a light emitting element. In an embodiment, a voltage level of the second power VSS may be lower than a voltage level of the first power VDD. For example, the voltage of the first power VDD may be a positive voltage, and the voltage of the second power VSS may be a negative voltage.

The reference power VREF may be a power for initializing a pixel PX. For example, a capacitor and/or a transistor included in the pixel PX may be initialized by the voltage of the reference power VREF. The reference power VREF may be a positive voltage.

The initialization power Vint may be power for initializing the pixel PX. For example, a driving transistor included in the pixel PX may be initialized by the voltage of the initialization power Vint. The initialization power Vint may be a negative voltage.

The anode initialization power Vaint may be power for initializing the pixel PX. For example, an anode of the light emitting element included in the pixel PX may be initialized by the voltage of the anode initialization power Vaint. The anode initialization power Vaint may be a negative voltage.

The bias power Vbs may be power for supplying a predetermined on-bias voltage to a source electrode of the driving transistor included in the pixel PX. The bias power Vbs may be a positive voltage. In an embodiment, the voltage of the bias power Vbs may be a level similar to a data voltage of a black grayscale. For example, the data voltage of the black grayscale may be used to cause a pixel to appear black.

The display device 1000 according to an embodiment may display an image at various image refresh rates (drive frequencies, or screen refresh rates) according to a driving condition. In an embodiment, the image refresh rate is a frequency at which a data signal is substantially written to the driving transistor of the pixel PX. For example, the image refresh rate may also be referred to as a screen scan rate or a screen refresh frequency, and indicates a frequency at which a display screen is refreshed for 1 second or each second.

In an embodiment, an output frequency of the data driver 600 for one horizontal line (or pixel row) and/or an output frequency of the first scan driver 200 outputting a write scan signal may be determined in response to the image refresh rate. For example, a refresh rate for driving a moving image may be a frequency of about 60 Hertz (Hz) or more (for example, 120 Hz).

In an embodiment, the display device 1000 may adjust an output frequency of the scan drivers 200, 300, and 400 for one horizontal line (or pixel row) and an output frequency of the data driver 600 corresponding thereto according to a driving condition. For example, the display device 1000 may display an image corresponding to various image refresh rates ranging from 1 Hz to 120 Hz. However, this is an example, and the display device 1000 may display an image also at an image refresh rate of 120 Hz or higher (for example, 240 Hz or 480 Hz).

The display panel 100 may include pixels PX respectively connected to data lines DL, scan lines SL1, SL2, and SL3, and an emission control line EL. The pixels PX may receive the voltages of the reference power VREF, the first power VDD, the second power VSS, the initialization power Vint, the anode initialization power Vaint, and the bias power Vbs from an outside source. In an embodiment, a pixel PX disposed in an i-th row and a j-th column (where i and j are natural numbers) may be connected to scan lines SL1*i*, SL2*i*, and SL3*i* corresponding to an i-th pixel row, emission control lines ELI corresponding to the i-th pixel row, and a data line DLj corresponding to a j-th pixel column.

In an embodiment of the disclosure, the signal lines SL1, SL2, SL3, EL, and DL connected to the pixel PX may be variously set in response to a circuit structure of the pixel PX.

The timing controller 700 may generate a first driving control signal SCS1, a second driving control signal SCS2, a third driving control signal SCS3, a fourth driving control signal ECS, and a fifth driving control signal DCS in response to synchronization signals supplied from an outside source. The first driving control signal SCS1 may be supplied to the first scan driver 200, the second driving control signal SCS2 may be supplied to the second scan driver 300, the third driving control signal SCS3 may be supplied to the third scan driver 400, the fourth driving control signal ECS may be supplied to the emission driver 500, and the fifth driving control signal DCS may be supplied to the data driver 600. In addition, the timing controller 700 may rearrange input image data supplied from the outside into image data RGB and supply the image data RGB to the data driver 600.

The first driving control signal SCS1 may include a first scan start pulse and clock signals. The first scan start pulse may control a first timing of a scan signal output from the first scan driver 200. The clock signals may be used to shift the first scan start pulse.

The second driving control signal SCS2 may include a second scan start pulse and clock signals. The second scan start pulse may control a first timing of a scan signal output from the second scan driver 300. The clock signals may be used to shift the second scan start pulse.

The third driving control signal SCS3 may include a third scan start pulse and clock signals. The third scan start pulse may control a first timing of a scan signal output from the third scan driver 400. The clock signals may be used to shift the third scan start pulse.

The fourth driving control signal ECS may include a first emission control start pulse and clock signals. The first emission control start pulse may control a first timing of the emission control signal output from the emission driver 500. The clock signals may be used to shift the first emission control start pulse.

The fifth driving control signal DCS may include a source start pulse and clock signals. The source start pulse may control a sampling start time point of data. The clock signals may be used to control a sampling operation.

The first scan driver 200 may receive the first driving control signal SCS1 from the timing controller 700, and supply a scan signal (for example, a first scan signal) to first scan lines SL1 based on the first driving control signal SCS1. For example, the first scan driver 200 may sequentially supply the first scan signal to the first scan lines SL1. When the first scan signal is sequentially supplied, the pixels PX may be selected in a horizontal line unit (or a pixel row unit), and a data signal may be supplied to the pixels PX. That is, the first scan signal may be a signal used for data writing.

The first scan signal may be set to a gate-on level (for example, a high voltage). A transistor included in a pixel PX and receiving the first scan signal may be set to a turn-on state when the first scan signal is supplied.

The first scan driver 200 may supply the scan signal to the first scan lines SL1 in a display scan period of one frame. For example, the first scan driver 200 may supply at least one scan signal to each of the first scan lines SL1 during the display scan period.

The second scan driver 300 may receive the second driving control signal SCS2 from the timing controller 700, and supply the scan signal (for example, a second scan signal) to second scan lines SL2 based on the second driving control signal SCS2. For example, the second scan driver 300 may sequentially supply the second scan signal to the second scan lines SL2. The second scan signal may be supplied to initialize a transistor and a capacitor included in the pixels PX and/or compensate for a threshold voltage (Vth). When the second scan signal is supplied, the pixels PX may perform threshold voltage compensation and/or initialization operations. The second scan signal may be set to a gate-on level (for example, a high voltage). A transistor included in a pixel PX and receiving the second scan signal may be set to a turn-on state when the second scan signal is supplied.

The second scan driver 300 may supply the scan signal to the second scan lines SL2 during the display scan period of one frame. For example, the second scan driver 300 may supply at least one scan signal to each of the second scan lines SL2 during the display scan period.

The third scan driver 400 may receive the third driving control signal SCS3 from the timing controller 700, and supply a scan signal (for example, a third scan signal) to third scan lines SL3 based on the third driving control signal SCS3. For example, the third scan driver 400 may sequentially supply the third scan signal to the third scan lines SL3. The third scan signal may be supplied for initialization of a driving transistor included in the pixels PX and/or initialization a capacitor included in the pixels PX. When the third scan signal is supplied, the pixels PX may perform an initialization operation of the driving transistor and/or an initialization operation of the capacitor.

The third scan signal may be set to a gate-on level (for example, a high voltage). A transistor included in a pixel PX and receiving the third scan signal may be set to a turn-on state when the third scan signal is supplied.

The emission driver 500 may receive the fourth driving control signal ECS from the timing controller 700 and supply the emission control signal to the emission control lines EL based on the fourth driving control signal ECS.

When the emission control signal is supplied, the pixels PX may not emit light in a horizontal line unit (or a pixel row unit).

In an embodiment, the emission control signals supplied to the emission control line EL may be repeatedly supplied for each predetermined period within one frame period. Accordingly, when the image refresh rate is reduced, the number of repetitions of an operation of supplying the emission control signals may be increased within one frame period.

The data driver 600 may receive the fifth driving control signal DCS and the image data RGB from the timing controller 700. The data driver 600 may supply the data signal to the data lines DL in response to the fifth driving control signal DCS. The data signal supplied to the data lines DL may be supplied to the pixels PX selected by the scan signal (for example, the first scan signal). The data driver 600 may supply the data signal to the data lines DL to be synchronized with the scan signal.

In an embodiment, the data driver 600 may supply the data signal to the data lines DL during one frame period in response to the image refresh rate. For example, the data driver 600 may supply the data signal to be synchronized with the scan signal supplied to the first scan lines SL1.

Figure 2:
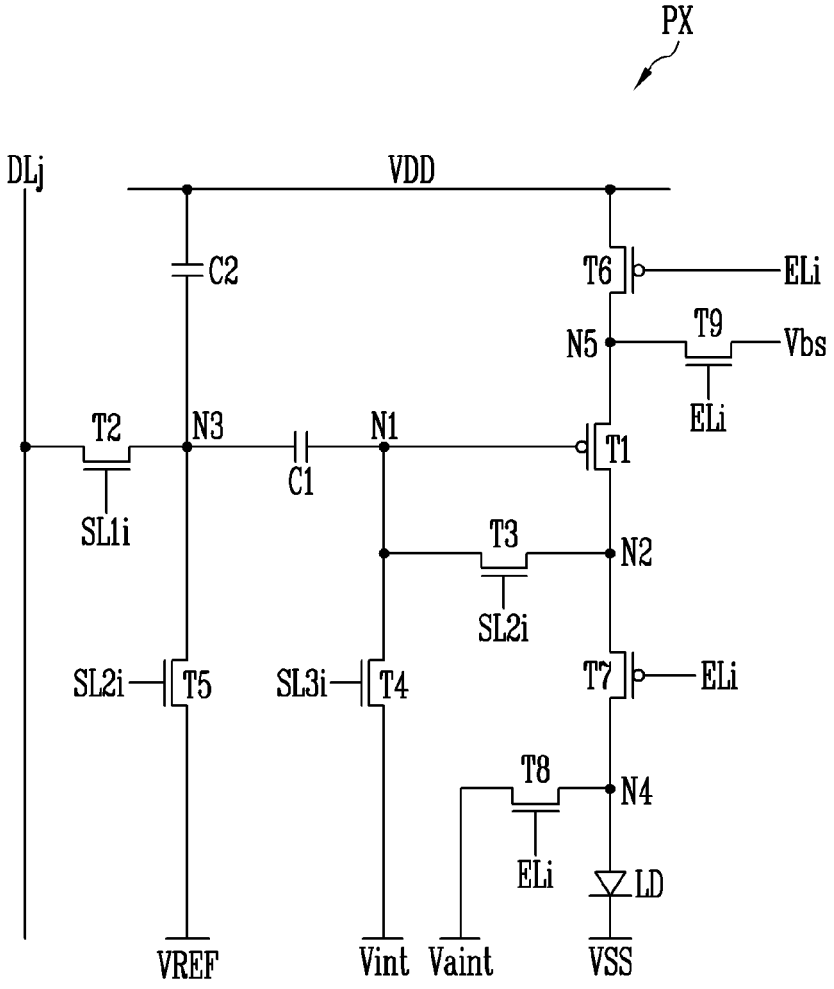
FIG. 2 is a circuit diagram illustrating a pixel according to an embodiment of the disclosure.

FIG. 2 is a circuit diagram illustrating a pixel according to an embodiment of the disclosure. In FIG. 2, the pixel PX positioned on the i-th horizontal line (or the i-th pixel row) and connected to the j-th data line DLj is shown for convenience of description.

Referring to FIG. 2, the pixel PX may include a light emitting element LD, first to ninth transistors T1 to T9, a first capacitor C1, and a second capacitor C2.

A first electrode of the light emitting element LD may be connected to a second electrode (for example, a drain electrode) of the first transistor T1 (or a second node N2) via the seventh transistor T7, and a second electrode of the light emitting element LD may be connected to the second power VSS. Specifically, the first electrode of the light emitting element LD may be electrically connected to the second electrode of the first transistor T1 via a fourth node N4 to which one electrode of the seventh transistor T7 and one electrode of the eighth transistor T8 are commonly connected.

The first transistor T1 may be connected to the first power VDD via the sixth transistor T6, and may be connected to the first electrode of the light emitting element LD via the seventh transistor T7. The first transistor T1 may generate a driving current and provide the driving current to the light emitting element LD. A gate electrode of the first transistor T1 may be connected to the first node N1. The first transistor T1 may function as a driving transistor of the pixel PX. The first transistor T1 may control an amount of current flowing from the first power VDD to the second power VSS via the light emitting element LD in response to a voltage applied to the first node N1.

The first capacitor C1 may be connected between the first node N1 and a third node N3 corresponding to the gate electrode of the first transistor T1. The first capacitor C1 may store a voltage corresponding to a voltage difference between the first node N1 and the third node N3.

The second capacitor C2 may be connected between the first power VDD and the third node N3. The second capacitor C2 may store a voltage corresponding to a voltage difference between the first power VDD and the third node N3. Since one electrode of the second capacitor C2 is connected to the first power VDD, which is a constant voltage source, and another electrode is connected to the third node N3, the second capacitor C2 may maintain a data signal (or a data voltage) applied to the third node N3 through the second transistor T2 in the display scan period during a self-scan period in which the data signal is not written. That is, the second capacitor C2 may stabilize a voltage of the third node N3.

The second transistor T2 may be connected between the data line DLj and the third node N3. The second transistor T2 may include a gate electrode receiving the scan signal. For example, the gate electrode of the second transistor T2 may be connected to a first scan line SL1*i* to receive the first scan signal. The second transistor T2 may be turned on when the first scan signal is supplied to the first scan line SL1*i*, to electrically connect the data line DLj and the third node N3. Accordingly, the data signal (or the data voltage) may be transmitted to the third node N3.

The third transistor T3 may be connected to the first node N1 corresponding to the gate electrode of the first transistor T1 and the second node N2 corresponding to the second electrode (or the drain electrode) of the first transistor T1. The third transistor T3 may include a gate electrode receiving the scan signal. For example, the gate electrode of the third transistor T3 may be connected to a second scan line SL2*i* to receive the second scan signal. The third transistor T3 may be turned on when the second scan signal is supplied to the second scan line SL2*i*, to electrically connect the first node N1 and the second node N2. By the turn-on of the third transistor T3, the first transistor T1 may have a diode connection type. When the first transistor T1 has the diode connection type, a threshold voltage of the first transistor T1 may be compensated.

The fourth transistor T4 may be connected between the initialization power Vint and the first node N1. The fourth transistor T4 may include a gate electrode receiving the scan signal. For example, the gate electrode of the fourth transistor T4 may be connected to a third scan line SL3*i* to receive the third scan signal. The fourth transistor T4 may be turned on when the third scan signal is supplied to the third scan line SL3*i*, to electrically connect the initialization power Vint and the first node N1. Accordingly, the voltage of the initialization power Vint may be supplied to the first node N1. Therefore, a voltage of the first node N1 may be initialized to the voltage of the initialization power Vint.

The fifth transistor T5 may be connected between the reference power VREF and the third node N3. The fifth transistor T5 may include a gate electrode receiving the scan signal. For example, the gate electrode of the fifth transistor T5 may be connected to a second scan line SL2*i* to receive the second scan signal. The fifth transistor T5 may be turned on when the second scan signal is supplied to the second scan line SL2*i*, to electrically connect the reference power VREF and the third node N3. Accordingly, the voltage of the reference power VREF may be supplied to the third node N3. Therefore, a voltage of the third node N3 may be initialized to the voltage of the reference power VREF.

Meanwhile, since the gate electrodes of the third and fifth transistors T3 and T5 are connected to the same scan line (that is, the second scan line SL2*i*), the third and fifth transistors T3 and T5 may be turned off or turned on simultaneously.

The sixth transistor T6 may be connected between the first power VDD and the first electrode of the first transistor T1 (or a fifth node N5). The sixth transistor T6 may include a gate electrode receiving the emission control signal. For example, the gate electrode of the sixth transistor T6 may be connected to the emission control line ELi to receive the emission control signal. The sixth transistor T6 may be turned off when the emission control signal is supplied to the emission control line ELi, and may be turned on in other cases. The sixth transistor T6 in a turned-on state may connect the first electrode of the first transistor T1 to the first power VDD.

The seventh transistor T7 may be connected between the second node N2 corresponding to the second electrode of the first transistor T1 and the anode of the light emitting element LD (or a fourth node N4). The seventh transistor T7 may include a gate electrode receiving the emission control signal. For example, the gate electrode of the seventh transistor T7 may be connected to the emission control line ELi to receive the emission control signal. The seventh transistor T7 may be turned off when the emission control signal is supplied to the emission control line ELI, and may be turned on in other cases. The seventh transistor T7 in a turned-on state may electrically connect the second node N2 and the fourth node N4.

Meanwhile, since the gate electrodes of the sixth and seventh transistors T6 and T7 are connected to the same emission control line ELI, the sixth and seventh transistors T6 and T7 may be turned off or turned on simultaneously. When both of the sixth and seventh transistors T6 and T7 are turned on, the light emitting element LD may emit light with a luminance corresponding to the voltage of the first node N1.

The eighth transistor T8 may be connected between the light emitting element LD (or the fourth node N4) and the anode initialization power Vaint. The eighth transistor T8 may include a gate electrode receiving the emission control signal. For example, the gate electrode of the eighth transistor T8 may be connected to the emission control line ELi to receive the emission control signal. The eighth transistor T8 may be turned on when the emission control signal is supplied to the emission control line ELI, to electrically connect the anode initialization power Vaint and the fourth node N4. Accordingly, a voltage of the fourth node N4 (or the anode of the light emitting element LD) may be initialized to the voltage of the anode initialization power Vaint.

When the voltage of the anode initialization power Vaint is supplied to the anode of the light emitting element LD, a parasitic capacitance of the light emitting element LD may be discharged. Since a residual voltage charged due to the parasitic capacitance is discharged (removed), unintentional fine emission may be prevented. Therefore, a black expression ability of the pixel PX may be improved.

The ninth transistor T9 may be connected between the first electrode of the first transistor T1 (or a fifth node N5) and the bias power Vbs. The ninth transistor T9 may include a gate electrode receiving the emission control signal. For example, the gate electrode of the ninth transistor T9 may be connected to the emission control line ELi to receive the emission control signal. The ninth transistor T9 may be turned on when the emission control signal is supplied to the emission control line ELi, to electrically connect the fifth node N5 and the bias power Vbs.

As described with reference to FIG. 1, the ninth transistor T9 may supply a high voltage to the first electrode of the first transistor T1 based on the bias power Vbs having a positive voltage. Accordingly, the first transistor T1 may have an on-bias state.

Meanwhile, a period in which the second transistor T2 is turned on and a period in which the third transistor T3 is turned on do not overlap. For example, when the third transistor T3 is turned on, threshold voltage compensation of the first transistor T1 may be performed, and when the second transistor T2 is turned on, data writing may be performed.

Therefore, a threshold voltage compensation period and a data writing period may be separated from each other.

In low-frequency driving in which a length of one frame period is increased, a hysteresis difference due to a grayscale difference between adjacent pixels may become large. Therefore, a difference of threshold voltage shift amounts of driving transistors of adjacent pixels may occur, and thus a screen drag (ghost phenomenon) may be recognized.

The display device according to an embodiment of the disclosure may periodically apply a bias with a predetermined voltage to the source electrode of the driving transistor (for example, the first transistor T1) using the ninth transistor T9. Therefore, a hysteresis deviation due to the grayscale difference between adjacent pixels may be removed, and thus screen drag due to the hysteresis deviation may be reduced (removed).

In an embodiment, the first, sixth, and seventh transistors T1, T6, and T7 may be P-type low-temperature poly-silicon (LTPS) thin film transistors, and the second, third, fourth, fifth, eighth, and ninth transistors T2, T3, T4, T5, T8, and T9 may be N-type oxide semiconductor thin film transistors. Meanwhile, all gate electrodes of each of the sixth, seventh, eighth, and ninth transistors T6, T7, T8, and T9 are connected to the emission control line Eli. However, since the sixth and seventh transistors T6 and T7 are P-type thin film transistors, and the eighth and ninth transistors T8 and T9 are N-type thin film transistors, the sixth and seventh transistors T6 and T7 and the eighth and ninth transistors T8 and T9 may operate in reverse in response to the emission control signal of the same level. In an embodiment, the sixth and seventh transistors T6 and T7 are transistors of a complementary type different from the eighth and ninth transistors T8 and T9.

FIGS. 3A to 3E are waveform diagrams illustrating an operation of the pixel shown in FIG. 2 in the display scan period.

Figure 3A:
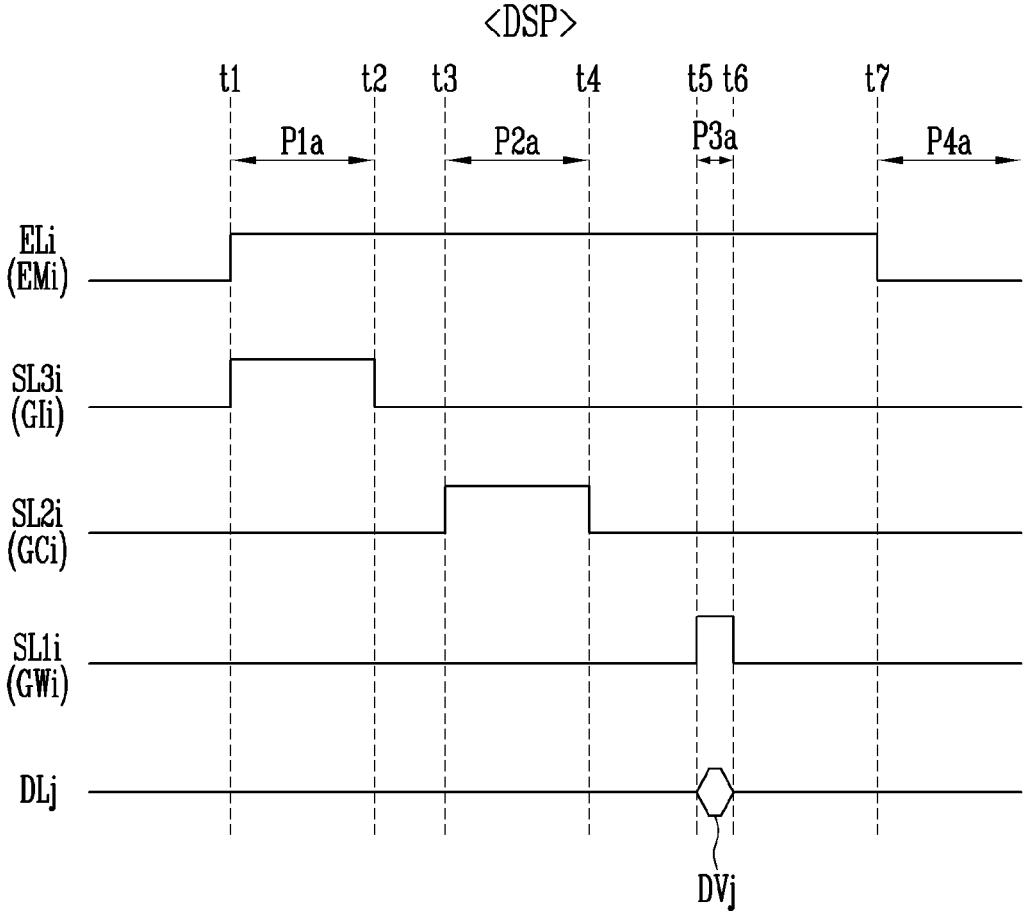
FIGS. 3A to 3E are waveform diagrams illustrating an operation of the pixel shown in FIG. 2 in a display scan period.

Referring to FIGS. 2 and 3A, the pixel PX may receive signals for image display during the display scan period DSP. The display scan period DSP may include a period in which a data signal DVj actually corresponding to an output image is written.

The emission control signal EMi may be supplied to the emission control lines ELI from a first time point t1 to a seventh time point t7 of the display scan period DSP. For example, the emission control signal EMi may be activated during the first time point t1 to the seventh time point t7. Accordingly, from the first time point t1 to the seventh time point t7, the sixth and seventh transistors T6 and T7 may be turned off, and the eighth and ninth transistors T8 and T9 may be turned on.

When the sixth and seventh transistors T6 and T7 are turned off, the pixel PX may be in a non-emission state, and when the sixth and seventh transistors T6 and T7 are turned on, the pixel PX may emit light.

While the emission control signal EMi is supplied, a third scan signal GIi may be supplied to the third scan line SL3*i* in a first period P1*a* from the first time point t1 to the second time point t2, a second scan signal GCi may be supplied to the second scan line SL2*i* in a second period P2*a* from the third time point t3 to the fourth time point t4, and a first scan signal GWi may be supplied to the first scan line SL1*i* in a third period P3*a* from the fifth time point t5 to the sixth time point t6. For example, the third scan signal GIi may be activated during the first period P1*a*, the second scan signal GCi may be activated during the second period P2*a* and the first scan signal GWi may be activated during the third period P3*a*.

At this time, the first period P1*a* may be a period for initializing the gate electrode of the first transistor T1, the second period P2*a* may be a period for compensating the threshold voltage of the first transistor T1, the third period P3*a* may be a period in which the data signal DVj is written, and a fourth period P4*a* may be an emission period (or a first emission period).

Figure 3B:
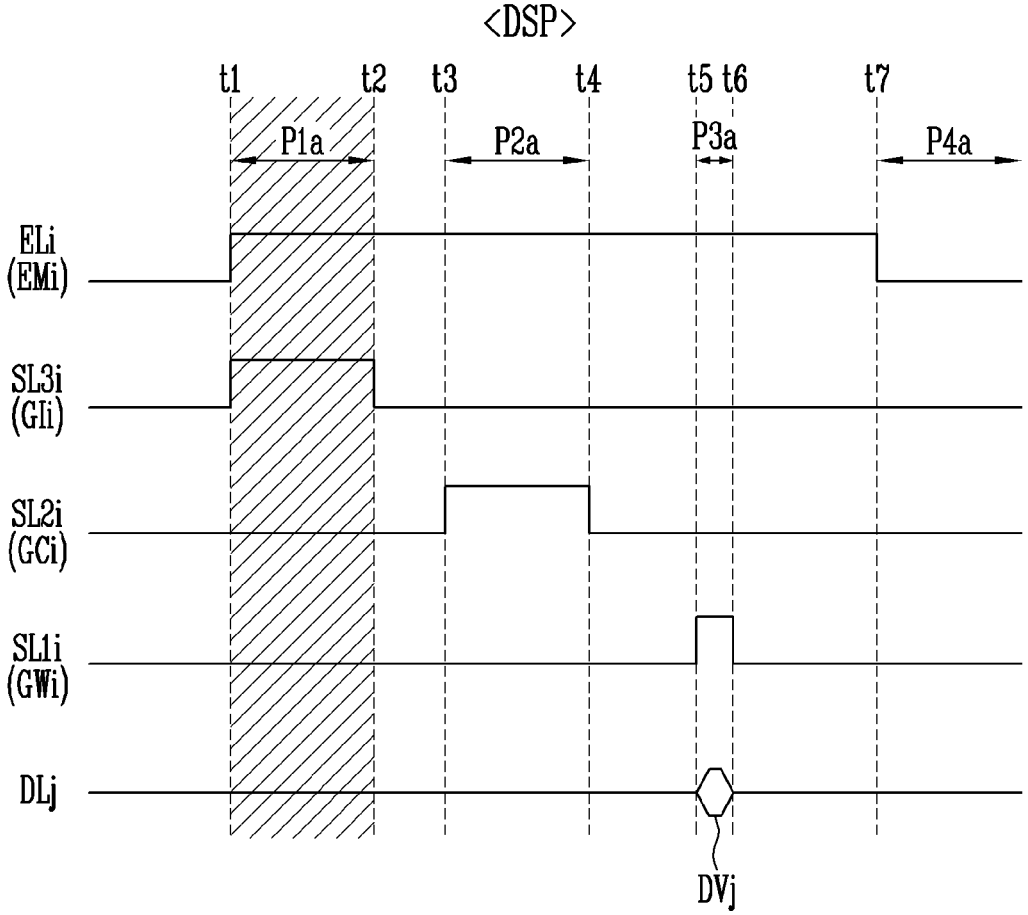

Referring to FIGS. 2 and 3B, supply of the emission control signal EMi may be maintained during the first period P1*a* and the third scan signal GIi may be supplied.

When the eighth transistor T8 is turned on, the voltage of the anode initialization power Vaint may be supplied to the fourth node N4. That is, during the first period P1*a*, the anode of the light emitting element LD may be initialized. For example, the anode of the light emitting element LD may be initialized by the anode initialization power Vaint.

When the ninth transistor T9 is turned on, the voltage of the bias power Vbs may be supplied to the fifth node N5. Therefore, the voltage of the bias power Vbs having a positive voltage may be supplied to the first electrode (or the source electrode) of the first transistor T1. That is, the on-bias voltage may be applied to the first transistor T1 during the first period P1*a*.

At the first time point t1, the third scan signal GIi may transit from a gate-off level to a gate-on level, and at the second time point t2, the third scan signal GIi may transit from the gate-on level to the gate-off level. Accordingly, since the fourth transistor T4 is turned on during the first period P1*a*, the voltage of the initialization power Vint may be supplied to the first node N1. That is, the gate electrode of the first transistor T1 may be initialized during the first period P1*a*. For example, the gate electrode of the first transistor T1 may be initialized by the initialization power Vint.

Figure 3C:
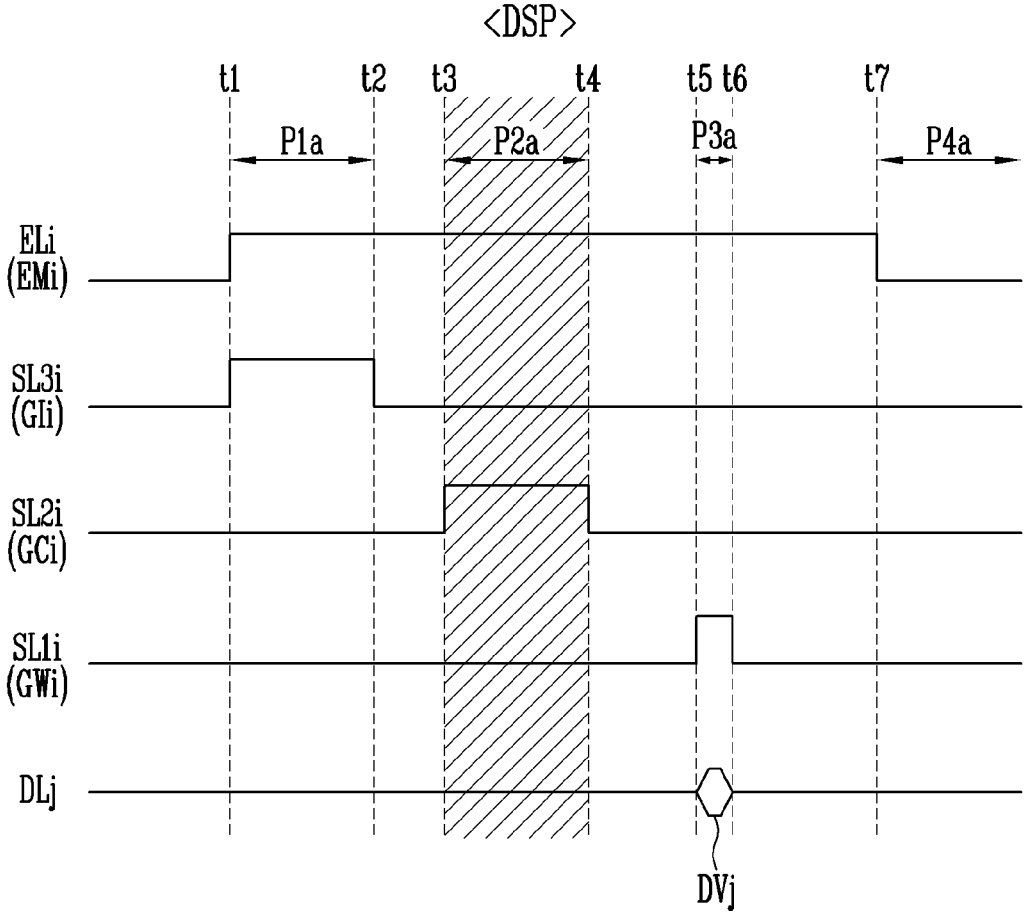

Referring to FIGS. 2 and 3C, the supply of the emission control signal EMi may be maintained during the second period P2*a* and the second scan signal GCi may be supplied.

When the eighth transistor T8 maintains a turn-on state, the voltage of the anode initialization power Vaint may be supplied to the fourth node N4. That is, the anode of the light emitting element LD may be initialized also during the second period P2*a*.

At the third time point t3, the second scan signal GCi may transit from the gate-off level to the gate-on level, and at the fourth time point t4, the second scan signal GCi may transit from the gate-on level to the gate-off level.

Accordingly, since the third transistor T3 is turned on during the second period P2*a*, the first node N1 and the second node N2 may be electrically connected. By the turn-on of the third transistor T3, the first transistor T1 may have a diode connection type or be diode connected. When the first transistor T1 has the diode connection type, the threshold voltage of the first transistor T1 may be compensated. At this time, since the ninth transistor T9 is turned on, the voltage of the bias power Vbs may be supplied to the first node N1 via the third transistor T3. That is, the pixel PX shown in FIG. 2 may compensate for the threshold voltage of the first transistor T1 with the voltage of the bias power Vbs of a constant voltage rather than a variable data voltage.

In addition, since the fifth transistor T5 is turned on by the second scan signal GCi of the gate-on level during the second period P2*a*, the voltage of the reference power VREF may be supplied to the third node N3. That is, the third node N3 may be initialized during the second period P2*a*.

Figure 3D:
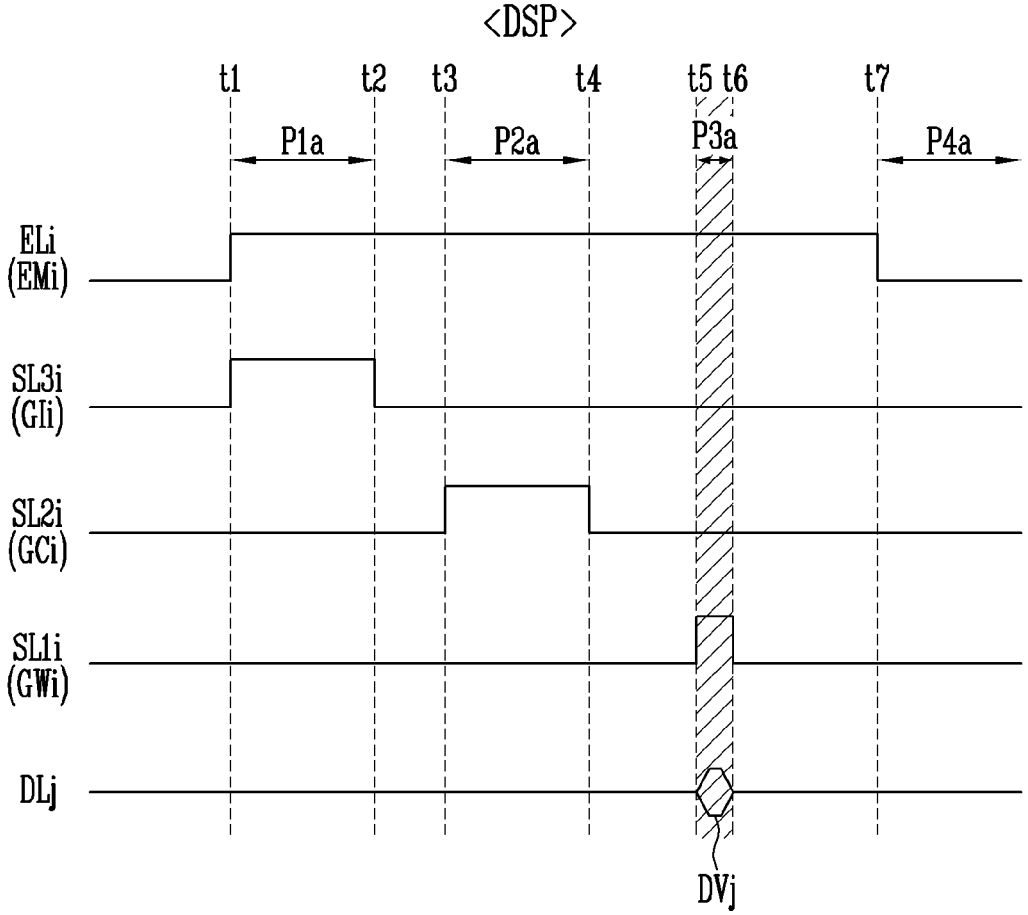

Referring to FIGS. 2 and 3D, the supply of the emission control signal EMi may be maintained during the third period P3*a* and the first scan signal GWi may be supplied.

When the eighth transistor T8 maintains a turn-on state, the voltage of the anode initialization power Vaint may be supplied to the fourth node N4. That is, the anode of the light emitting element LD may be initialized also during the third period P3*a*.

When the ninth transistor T9 maintains a turn-on state and the third transistor T3 is turned off, the voltage of the bias power Vbs may be supplied to the fifth node N5. Therefore, the voltage of the bias power Vbs having a positive voltage may be supplied to the first electrode (or the source electrode) of the first transistor T1 again. That is, the on-bias voltage may be re-applied to the first transistor T1 during the third period P3*a*.

At the fifth time point t5, the first scan signal GWi may transit from the gate-off level to the gate-on level, and at the sixth time point t6, the first scan signal GWi may transit from the gate-on level to the gate-off level. Accordingly, since the second transistor T2 is turned on during the third period P3*a*, the data line DLj and the third node N3 may be electrically connected, and thus the data signal DVj may be supplied to the third node N3.

Since the first node N1 is connected to the third node N3 by the first capacitor C1, a change amount (that is, "DATA-VREF") of a voltage of the third node N3 may be reflected in the third node N3. Here, DATA may be a voltage corresponding to the data signal DVj, and VREF may be the voltage of the reference power VREF.

That is, the data signal DVj may be written or applied to the pixel PX during the third period P3*a*.

Figure 3E:
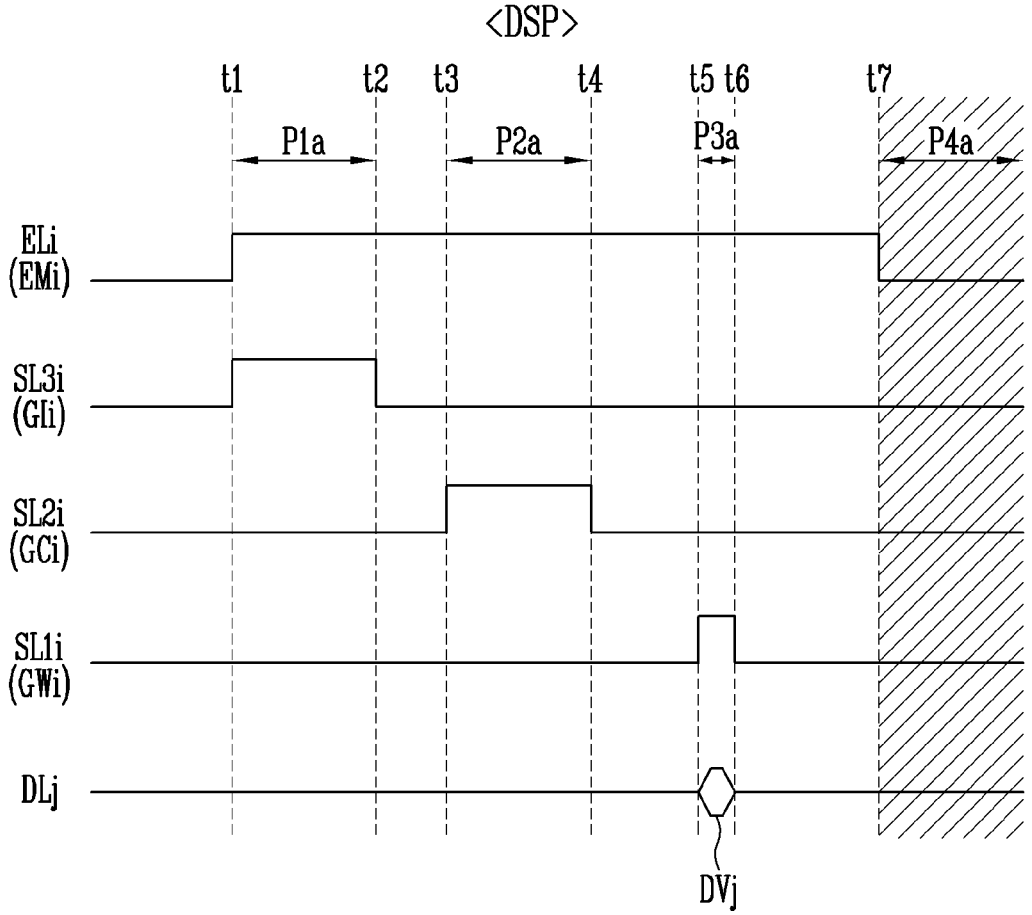

Referring to FIGS. 2 and 3E, the first to third scan signals GWi, GCi, and GIi and the emission control signal EMi may not be supplied during the fourth period P4*a*. For example, the first to third scan signals GWi, GCi, and GIi may be deactivated during the fourth period P4*a*.

When the emission control signal EMi is not supplied, the sixth and seventh transistors T6 and T7 may be turned on, and the eighth and ninth transistors T8 and T9 may be turned off. When both of the sixth and seventh transistors T6 and T7 are turned on, the light emitting element LD may emit light with a luminance corresponding to the voltage of the first node N1. That is, the pixel PX may emit light during the fourth period P4*a*.

As described above, the pixel PX shown in FIG. 2 may implement the sixth and seventh transistors T6 and T7 with P-type low-temperature poly-silicon (LTPS) thin film transistors, implement the eighth and ninth transistors T8 and T9 with N-type oxide semiconductor thin film transistors, and integrally controlling the gate electrodes of each of the sixth, seventh, eighth, and ninth transistors T6, T7, T8, and T9 by connecting the gate electrodes of each of the sixth, seventh, eighth, and ninth transistors T6, T7, T8, and T9 to the same emission control line Eli. Therefore, the pixel PX shown in FIG. 2 may perform the initialization of the pixel PX, the threshold voltage compensation, the data writing, and the voltage application of the bias power Vbs using a smaller number of signal control lines (for example, scan lines, and emission control lines). Meanwhile, since the number of signal control lines included in the pixel PX is reduced, a high-resolution display panel 100 may be realized, and the number of scan drivers and/or emission drivers may be reduced in response to the reduced signal control lines. Therefore, a non-display area or bezel area of the display panel 100 may be minimized.

Figure 4A:
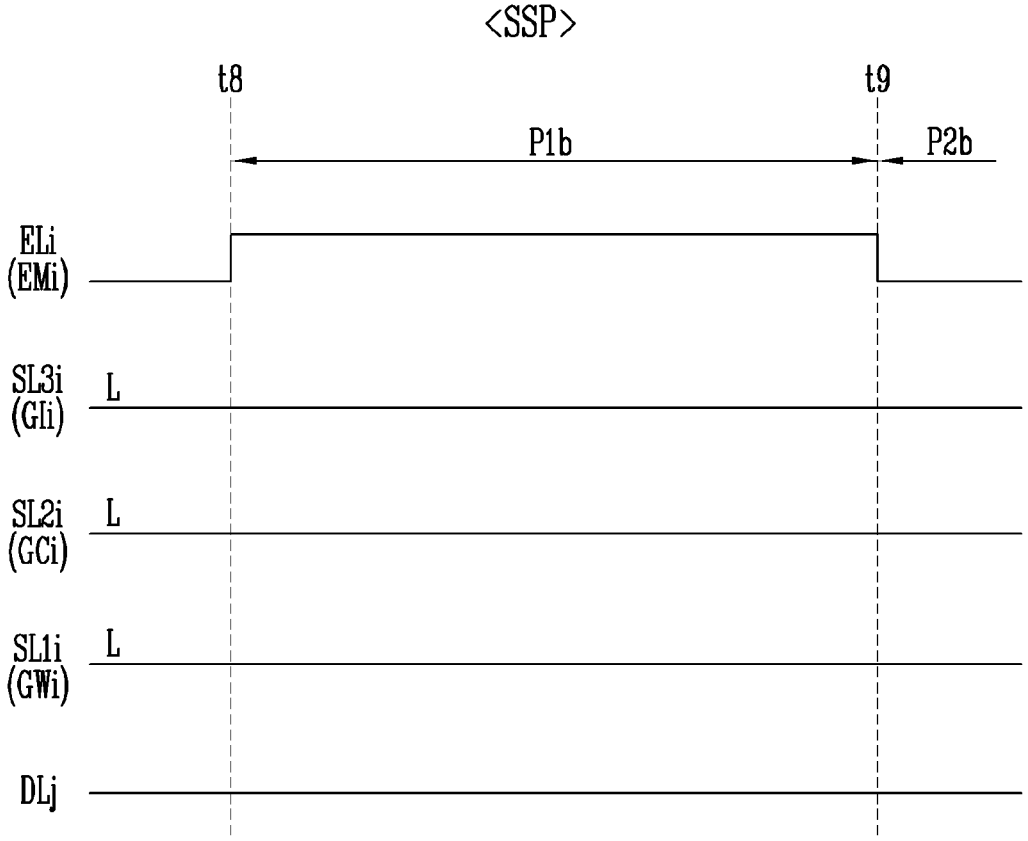
FIGS. 4A to 4C are waveform diagrams illustrating the operation of the pixel shown in FIG. 2 in a self-scan period.
Figure 4B:
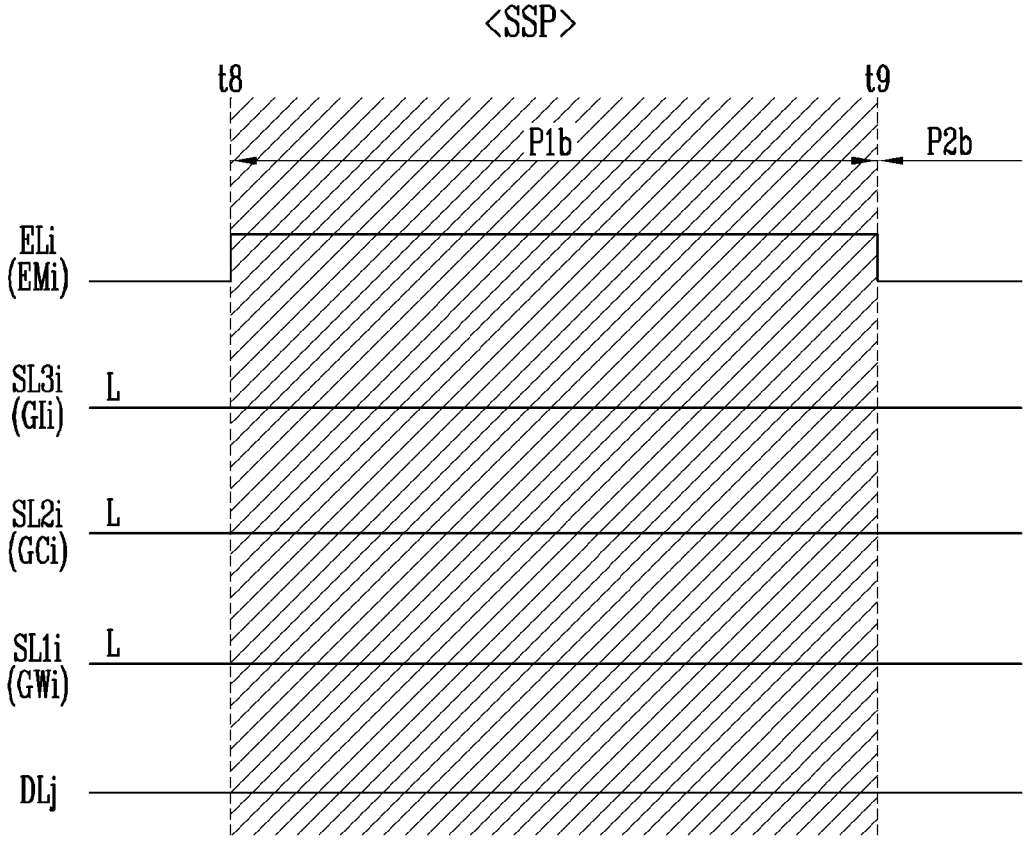
Figure 4C:
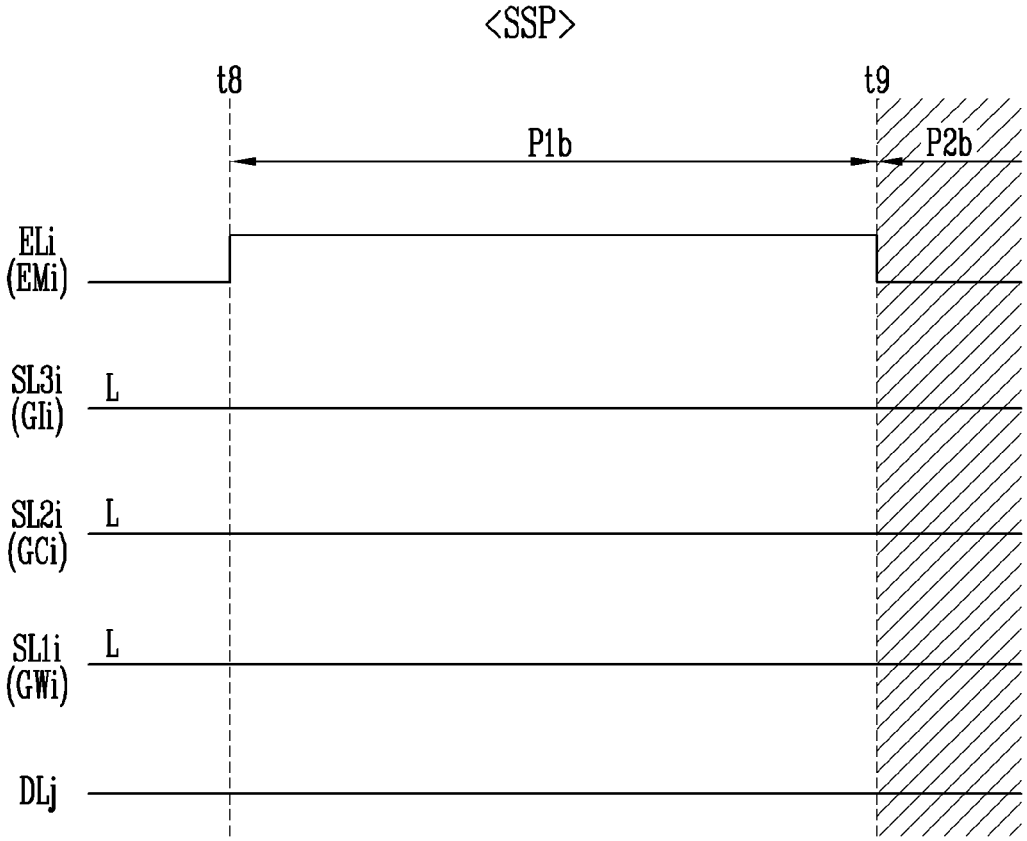

FIGS. 4A to 4C are waveform diagrams illustrating the operation of the pixel shown in FIG. 2 in the self-scan period.

Referring to FIGS. 2, 3A, and 4A, in order to maintain a luminance of an image output during the display scan period DSP, the voltage of the bias power Vbs may be applied to the first electrode of the first transistor T1 (or the fifth node N5).

According to the image frame rate, one frame may include at least one self-scan period SSP. The self-scan period SSP may include an on-bias period of a fifth period P1*b* and an emission period (or a second emission period) of a sixth period P2*b*.

The emission control signal EMi may be supplied to the emission control lines ELI from the eighth time point t8 to the ninth time point t9 of the self-scan period SSP. For example, the emission control signal EMi may be activated during the sixth period P2*b*. Accordingly, from the eighth time point t8 to the ninth time point t9, the sixth and seventh transistors T6 and T7 may be turned off, and the eighth and ninth transistors T8 and T9 may be turned on. When the sixth and seventh transistors T6 and T7 are turned off, the pixel PX may be in a non-emission state. When the sixth and seventh transistors T6 and T7 are turned on, the pixel PX may emit light.

Even while the emission control signal EMi is supplied in the self-scan period SSP, the first to third scan signals GWi, GCi, and GIi may not be supplied. For example, the first to third scan signals GWi, GCi, and GIi may be deactivated during the self-scan period SSP.

Referring to FIGS. 2 and 4B, the supply of the emission control signal EMi may be maintained during the fifth period P1*b* and the first to third scan signals GWi, GCi, and GIi may not be supplied.

When the eighth transistor T8 is turned on, the voltage of the anode initialization power Vaint may be supplied to the fourth node N4. That is, the anode of the light emitting element LD may be initialized during the fifth period P1*b*.

When the ninth transistor T9 is turned on, the voltage of the bias power Vbs may be supplied to the fifth node N5. Therefore, the voltage of the bias power Vbs having a positive voltage may be supplied to the first electrode (or the source electrode) of the first transistor T1. That is, the on-bias voltage may be applied to the first transistor T1 during the fifth period P1*b*.

Referring to FIGS. 2 and 4C, the first to third scan signals GWi, GCi, and GIi and the emission control signal EMi may not be supplied during the sixth period P2*b*. For example, the first to third scan signals GWi, GCi, and GIi and the emission control signal Emi may be deactivated during the sixth period P2*b*.

When the emission control signal EMi is not supplied, the sixth and seventh transistors T6 and T7 may be turned on, and the eighth and ninth transistors T8 and T9 may be turned off. When both of the sixth and seventh transistors T6 and T7 are turned on, the light emitting element LD may emit light with a luminance corresponding to the voltage of the first node N1. That is, the pixel PX may emit light during the sixth period P2*b*.

As described above, in the self-scan period SSP, the data driver 600 of FIG. 1 may not supply the data signal to the pixel PX. Therefore, power consumption may be further reduced.

Figure 5:
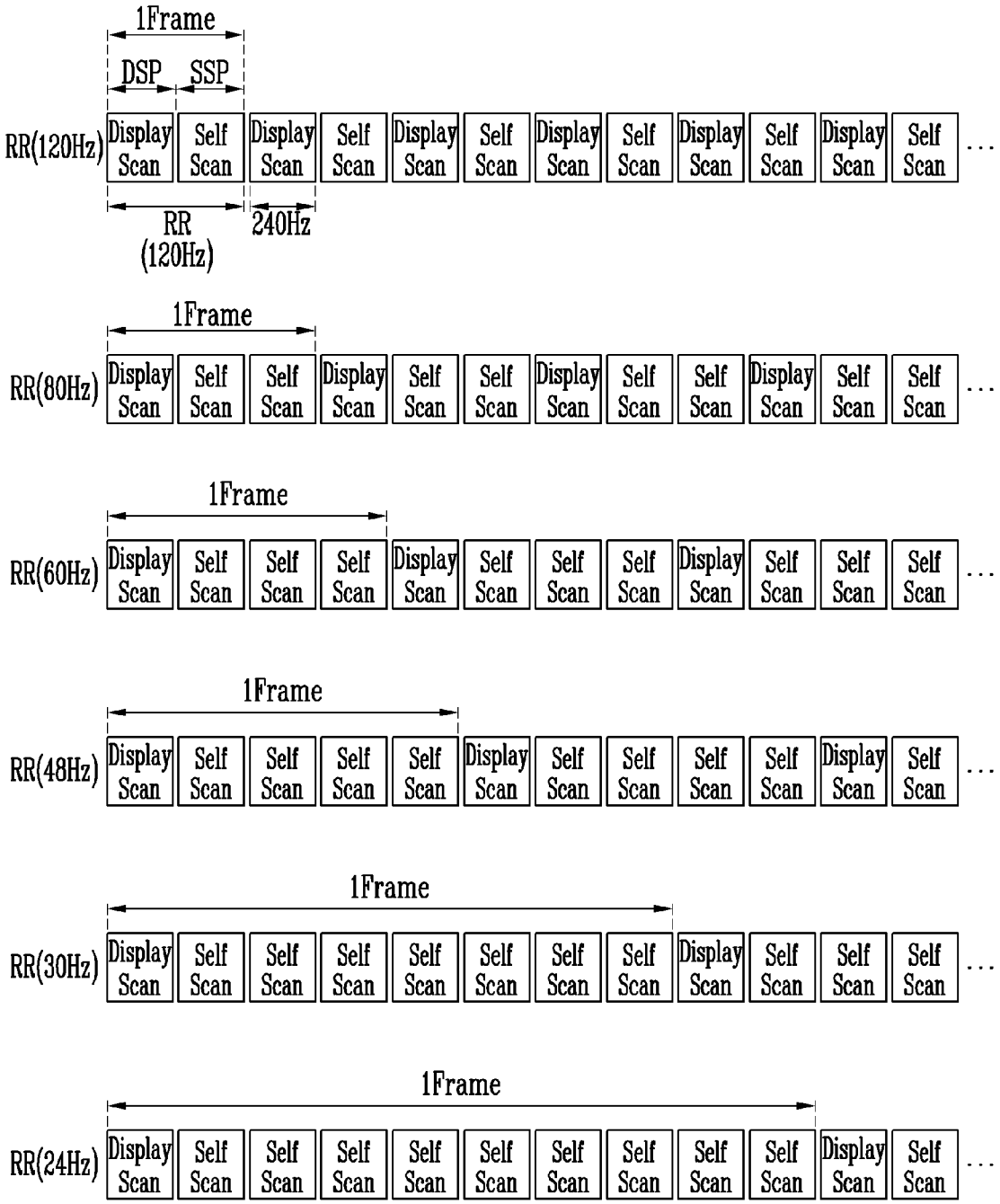
FIG. 5 is a conceptual diagram illustrating an example of a method of driving the display device according to an image refresh rate.

FIG. 5 is a conceptual diagram illustrating an example of a method of driving the display device according to the image refresh rate.

Referring to 1 to 5, the pixel PX may perform the operation of FIGS. 3A to 3E in the display scan period DSP and perform the operation of FIGS. 4A to 4C in the self-scan period SSP.

In an embodiment, lengths of the display scan period DSP and the self-scan period SSP are the same or substantially the same. However, the number of self-scan periods SSP included in one frame period may be determined according to the image refresh rate RR.

As shown in FIG. 5, when the display device 1000 is driven at an image refresh rate RR of 120 Hz, one frame period may include one display scan period DSP and one self-scan period SSP. Accordingly, when the display device 1000 is driven at the image refresh rate RR of 120 Hz, each of the pixels PX may alternately repeat emission and non-emission twice during one frame period.

In addition, when the display device 1000 is driven at an image refresh rate RR of 80 Hz, one frame period may include one display scan period DSP and two successive self-scan periods SSP. Accordingly, when the display device 1000 is driven at the image refresh rate RR of 80 Hz, each of the pixels PX may alternately repeat emission and non-emission three times during one frame period.

In a method similar to that described above, the display device 1000 may be driven at a driving frequency of 60 Hz, 48 Hz, 30 Hz, 24 Hz, 1 Hz, or the like by adjusting the number of self-scan periods SSP included in one frame period.

In addition, as the driving frequency decreases, the number of self-scan periods SSP increases, and thus on-bias and/or off-bias of a predetermined size may be periodically applied to each of the first transistors T1 included in each of the pixels PX. Therefore, luminance reduction, flicker, and screen drag in low-frequency driving may be improved.

Hereinafter, other embodiments are described. In the following embodiment, a description of the same configuration as that of the previously described embodiment is omitted or simplified, and a difference is mainly described.

Figure 6A:
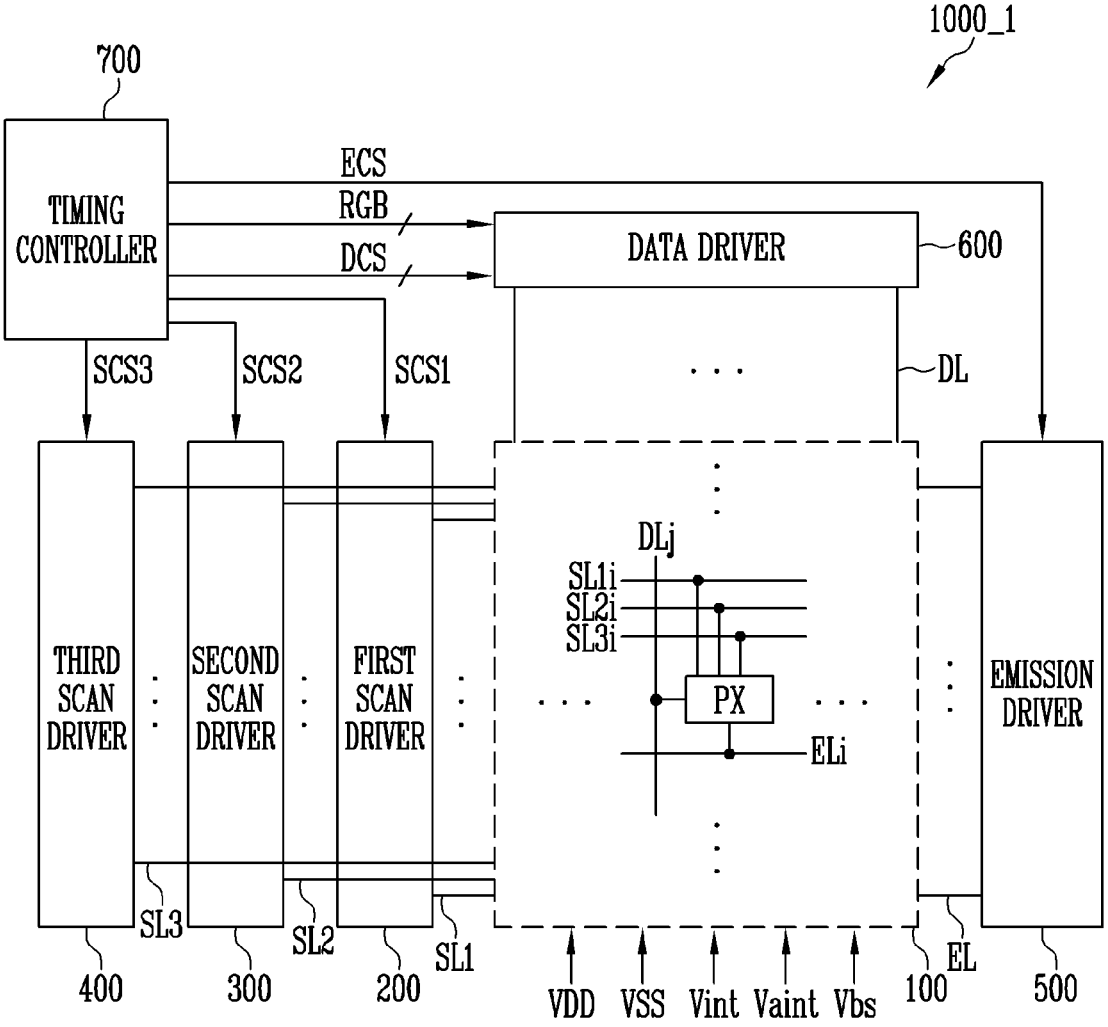
FIG. 6A is a block diagram illustrating a display device according to an embodiment of the disclosure.
Figure 6B:
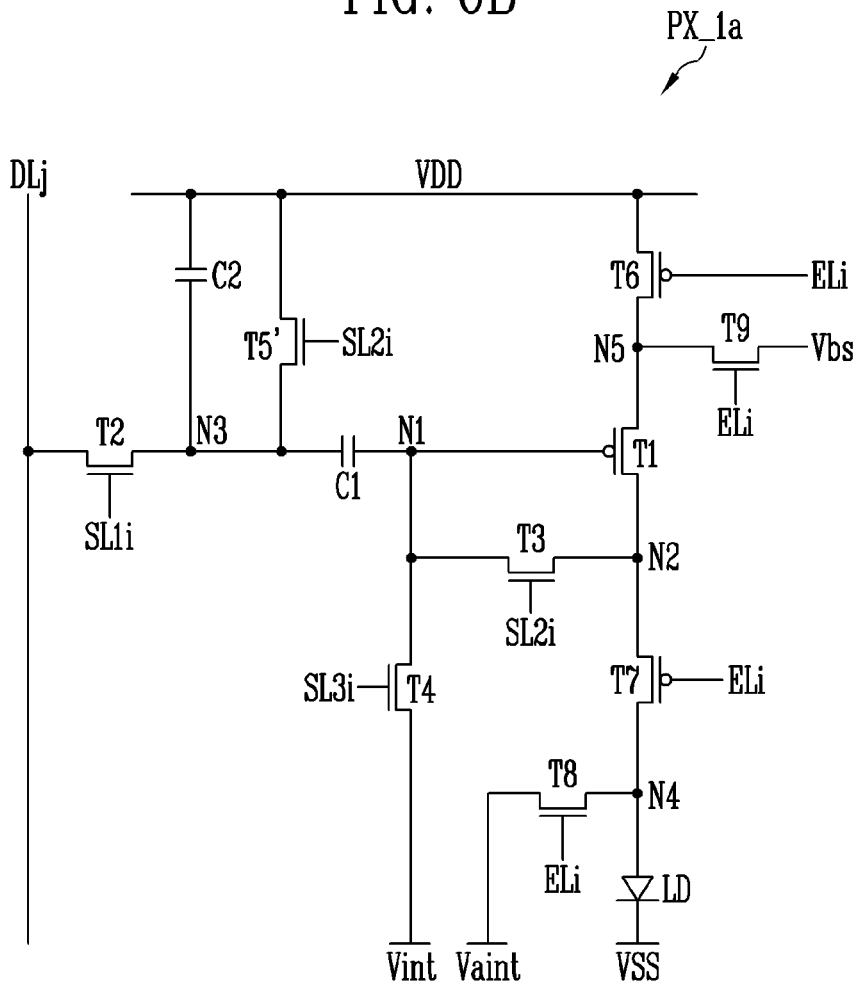
FIGS. 6B and 6C are circuit diagrams illustrating a pixel according to an embodiment of the disclosure.
Figure 6C:
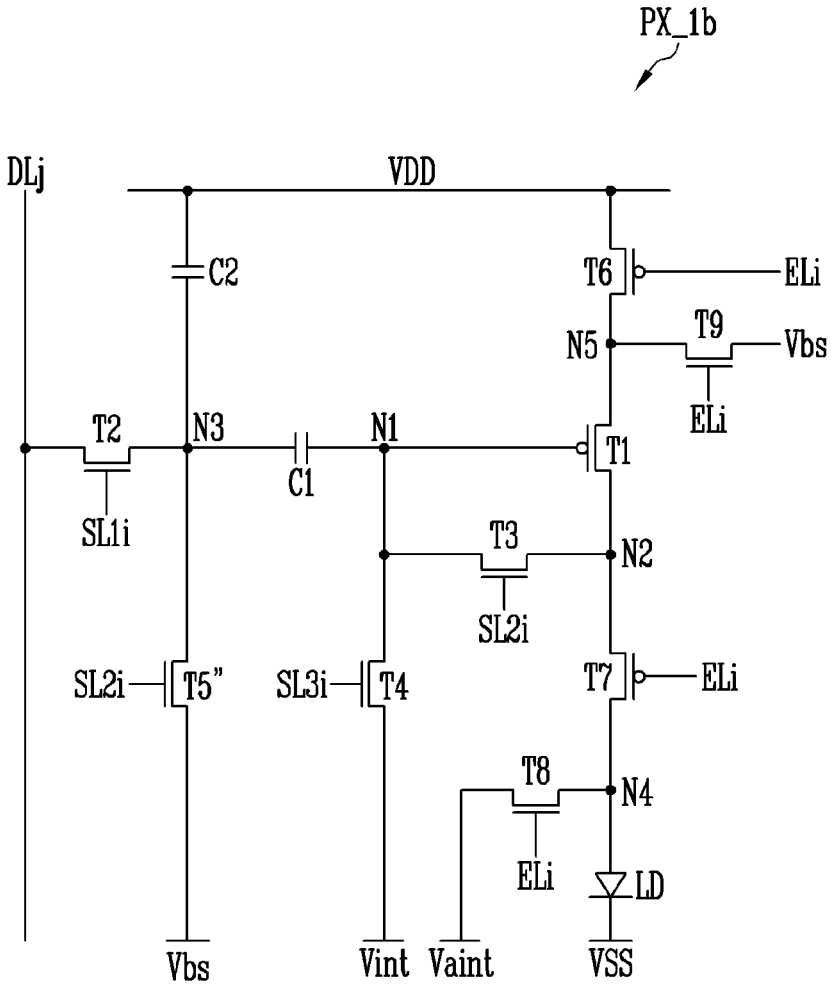

FIG. 6A is a block diagram illustrating a display device according to another embodiment of the disclosure. FIGS. 6B and 6C are circuit diagrams illustrating a pixel according to an embodiment of the disclosure.

The display device 1000_1 of FIG. 6A is only different from the display device 1000 of FIG. 1 in that the third power VREF (or the reference power) is omitted among the power supplied to the display panel 100, and other configurations are substantially the same. That is, the voltage of the first power VDD, the voltage of the second power VSS, the voltage of the fourth power Vint (or the initialization power), the voltage of the fifth power Vaint (or the anode initialization power), and the voltage of the sixth power Vbs (or the bias power) may be provided to the display panel 100 of the display device 1000_1 shown in FIG. 6A.

The pixel PX_1*a* of FIG. 6B is only different from the pixel PX of FIG. 2 in which the voltage supplied to one electrode of the fifth transistor T5 is the voltage of the third power VREF (or the reference power), in that a voltage supplied to one electrode of a fifth transistor T5' is the voltage of the first power VDD, and other configurations are substantially the same. Referring to FIGS. 3A and 6B, since the fifth' transistor T5' is turned on by the second scan signal GCi of the gate-on level during the second period P2*a*, the voltage of the first power VDD may be supplied to the third node N3.

The pixel PX_1*b* of FIG. 6C is only different from the pixel PX of FIG. 2 in which the voltage supplied to one electrode of the fifth transistor T5 is the voltage of the third power VREF (or the reference power), in that a voltage supplied to one electrode of a fifth transistor T5" is the voltage of the sixth power Vbs (or the bias power), and other configurations are substantially the same. Referring to FIGS. 3A and 6C, since the fifth transistor T5" is turned on by the second scan signal GCi of the gate-on level during the second period P2*a*, the voltage of the sixth power Vbs (or the bias power) may be supplied to the third node N3.

As described above, when the first power VDD is used as shown in FIG. 6B or when the sixth power Vbs (or the bias power) is used as shown in FIG. 6C instead of using the separate third power VREF (or the reference power) to initialize the third node N3, the number of power lines disposed in the pixel PX may be reduced, and thus a high-resolution display panel 100 (refer to FIG. 6A) may be realized.

Figure 7A:
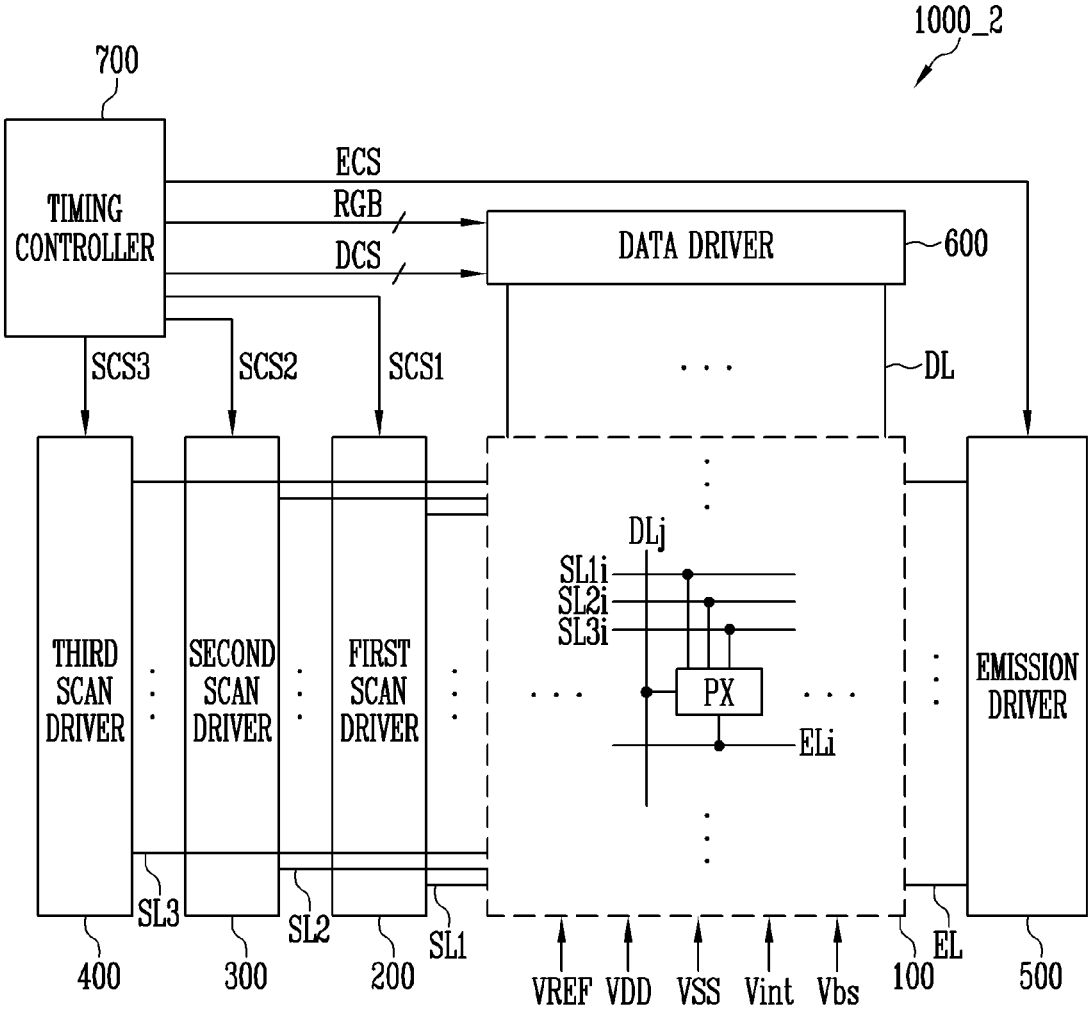
FIG. 7A is a block diagram illustrating a display device according to an embodiment of the disclosure.
Figure 7B:
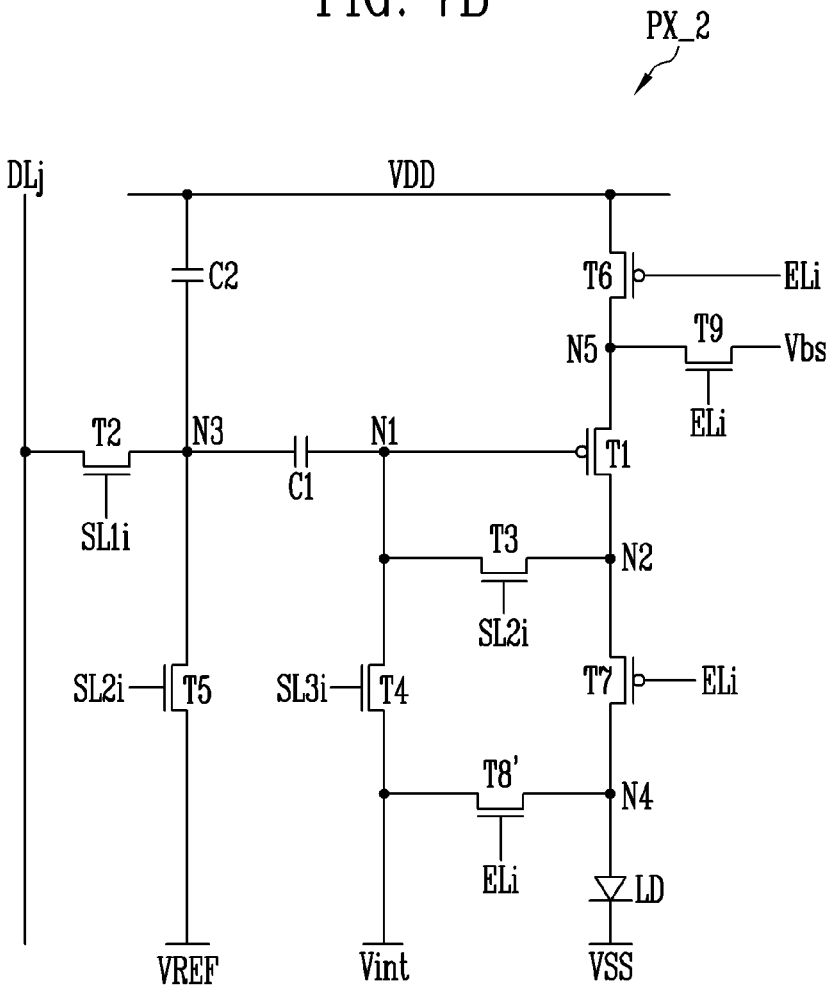
FIG. 7B is a circuit diagram illustrating a pixel according to an embodiment of the disclosure.

FIG. 7A is a block diagram illustrating a display device according to still another embodiment of the disclosure. FIG. 7B is a circuit diagram illustrating a pixel according to an embodiment of the disclosure.

The display device 1000_2 of FIG. 7A is only different from the display device 1000 of FIG. 1 in that the fifth power Vaint (or the anode initialization power) is omitted among the power supplied to the display panel 100, and other configurations are substantially the same. That is, the voltage of the first power VDD, the voltage of the second power VSS, the voltage of the third power VREF (or the reference power), the voltage of the fourth power Vint (or initialization power), and the voltage of the sixth power Vbs (or the bias power) may be provided to the display panel 100 of the display device 1000_1 shown in FIG. 7A.

The pixel PX_2 of FIG. 7B is only different from the pixel PX of FIG. 2 in which the voltage supplied to one electrode of the eighth transistor T8 is the voltage of the fifth power Vaint (or the anode initialization power), in that a voltage supplied to one electrode of an eighth transistor T8' is the voltage of the fourth power Vint (or the initialization power), and other configurations are substantially the same. Referring to FIGS. 3A and 7B, the eighth transistor T8' is turned on by the emission control signal EMi of the high level supplied from the first time point t1 to the seventh time point t7, the voltage of the fourth power Vint may be supplied to the fourth node N4. That is, the anode of the light emitting element LD may be initialized with the voltage of the initialization power Vint from the first time point t1 to the seventh time point t7.

As described above, when the fourth power Vint (or the initialization power) is used as shown in FIG. 7B instead of using the separate fifth power Vaint (or the anode initialization power) to initialize the fourth node N4 (or the anode of the light emitting element LD), the number of power lines disposed in the pixel PX may be reduced, and thus a high-resolution display panel 100 (refer to FIG. 7A) may be implemented.

Figure 8A:
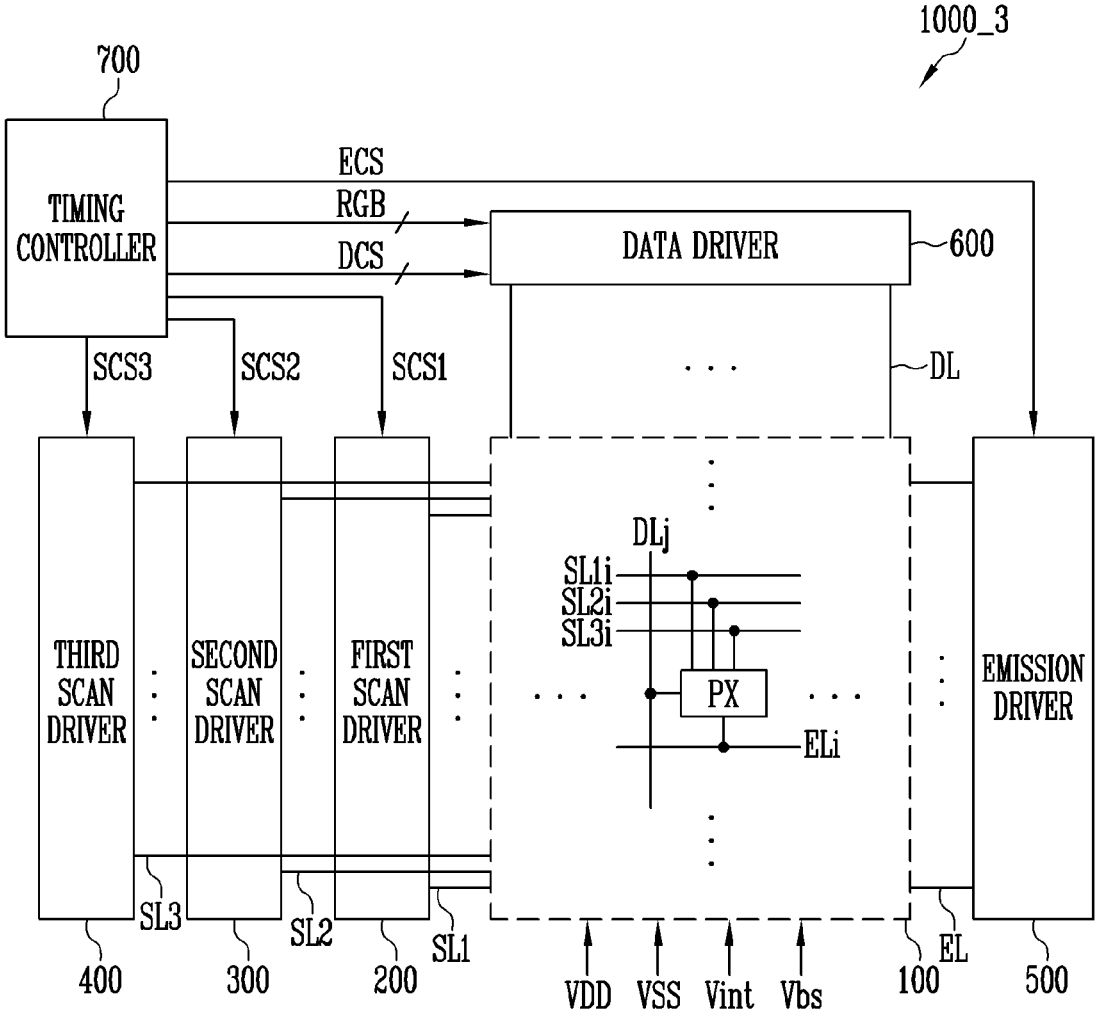
FIG. 8A is a block diagram illustrating a display device according to an embodiment of the disclosure.
Figure 8B:
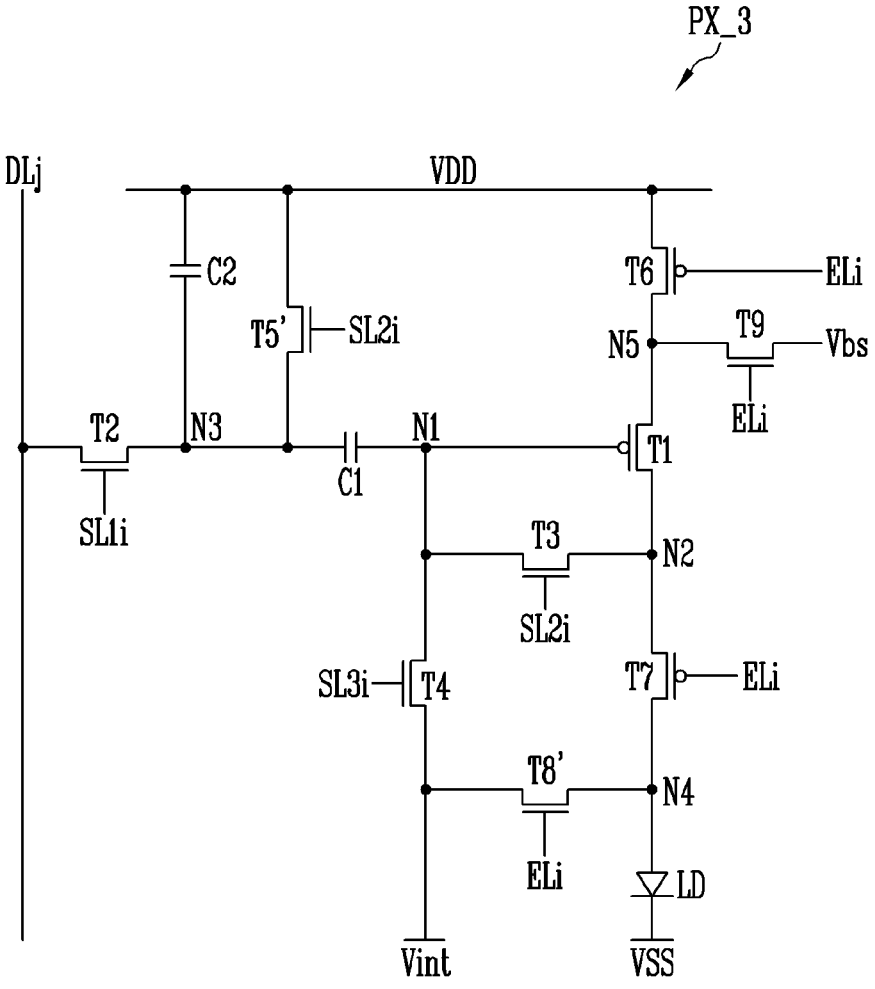
FIG. 8B is a circuit diagram illustrating a pixel according to an embodiment of the disclosure.

FIG. 8A is a block diagram illustrating a display device according to an embodiment of the disclosure. FIG. 8B is a circuit diagram illustrating a pixel according to an embodiment of the disclosure.

The display device 1000_3 of FIG. 8A is only different from the display device 1000 of FIG. 1 in that the third power VREF (or the reference power) and the fifth power Vaint (or the anode initialization power) are omitted among the power supplied to the display panel 100, and other configurations are substantially the same. That is, the voltage of the first power VDD, the voltage of the second power VSS, the voltage of the fourth power Vint (or the initialization power), and the voltage of the sixth power Vbs (or the bias power) may be provided to the display panel 100 of the display device 1000_3 shown in FIG. 8A.

The pixel PX_3 of FIG. 8B is only different from the pixel PX of FIG. 2 in which the voltage supplied to one electrode of the fifth transistor T5 is the voltage of the third power VREF (or the reference power) and the voltage supplied to one electrode of the eighth transistor T8 is the fifth power Vaint (or the anode initialization power), in that the voltage supplied to one electrode of the fifth transistor T5' is the voltage of the first power VDD and the voltage supplied to one electrode of the eighth transistor T8' is the voltage of the fourth power Vint (or the initialization power), and other configurations are substantially the same.

Referring to FIGS. 3A and 8B, since the fifth transistor T5' is turned on by the second scan signal GCi of the gate-on level during the second period P2*a*, the voltage of the first power VDD may be supplied to the third node N3, and since the eighth transistor T8' is turned on by the emission control signal EMi of the high level supplied from the first time point t1 to the seventh time point t7, the voltage of the fourth power Vint may be supplied to the fourth node N4.

As described above, when the first power VDD is used as shown in FIG. 8B instead of using the separate third power VREF (or the reference power) to initialize the third node N3, and when the fourth power Vint (or the initialization power) is used as shown in FIG. 8B instead of using the separate fifth power Vaint (or the anode initialization power) to initialize the fourth node N4 (or the anode of the light emitting element LD), the number of power lines disposed in the pixel PX may be further reduced, and thus a high-resolution display panel 100 (refer to FIG. 8A) may be realized.

Although the above has been described with reference to embodiments of the disclosure, those skilled in the art will understand that the disclosure may be variously modified and changed without departing from the spirit and scope of the disclosure described in the claims below.

What is claimed is:

1. A pixel of a display device, the pixel comprising:

a light emitting element;

a first transistor comprising a gate electrode connected to a first node, wherein the first transistor is connected between first power and a second node and controls a driving current supplied to the light emitting element;

a first capacitor including one electrode connected to the first node and another electrode connected to a third node;

a second transistor connected between the third node and a data line;

a third transistor connected between the first node and the second node;

a sixth transistor connected between the first power and a fifth node connected to one electrode of the first transistor;

a seventh transistor connected between the second node and a fourth node connected to the light emitting element; and a ninth transistor connected between the fifth node and bias power, wherein gate electrodes of each of the sixth transistor, the seventh transistor, and the ninth transistor are connected to a same emission control line.

2. The pixel according to claim 1, further comprising:

an eighth transistor connected between the fourth node and anode initialization power, wherein a gate electrode of the eighth transistor is connected to the emission control line.

3. The pixel according to claim 2, wherein the sixth transistor and the seventh transistor are P-type thin film transistors, and the eighth transistor and the ninth transistor are N-type thin film transistors.

4. The pixel according to claim 2, further comprising:

a fourth transistor connected between the first node and initialization power; and a fifth transistor connected between reference power and the third node.

5. The pixel according to claim 4, wherein the second transistor, the third transistor, the fourth transistor, the fifth transistor, the eighth transistor, and the ninth transistor are N-type thin film transistors.

6. The pixel according to claim 4, wherein the second transistor is turned on by a first scan signal, the third transistor is turned on by a second scan signal, the fourth transistor is turned on by a third scan signal, the fifth transistor is turned on by the second scan signal, the sixth transistor is turned off by an emission control signal, the seventh transistor is turned off by the emission control signal, the eighth transistor is turned on by the emission control signal, and the ninth transistor is turned on by the emission control signal.

7. The pixel according to claim 6, wherein the third scan signal, the second scan signal, and the first scan signal are sequentially provided during a period in which the emission control signal is supplied.

8. The pixel according to claim 7, wherein when the eighth transistor is turned on by the emission control signal, a voltage of the anode initialization power is supplied to the fourth node, and when the ninth transistor is turned on by the emission control signal, a voltage of the bias power is supplied to the fifth node.

9. The pixel according to claim 8, wherein when the fourth transistor is turned on by the third scan signal, a voltage of the initialization power is supplied to the first node.

10. The pixel according to claim 8, wherein when the third transistor is turned on by the second scan signal, the first transistor is diode connected.

11. The pixel according to claim 10, wherein when the ninth transistor is turned on by the emission control signal, a voltage of the first node is a difference value between a voltage of the bias power and a threshold voltage of the first transistor.

12. The pixel according to claim 8, wherein when the second transistor is turned on by the first scan signal, a data signal is provided from the data line to the third node.

13. The pixel according to claim 2, further comprising:

a fourth transistor connected between the first node and initialization power; and a fifth transistor connected between the bias power and the third node.

14. The pixel according to claim 1, further comprising:

a second capacitor including one electrode connected to the first power and another electrode connected to the third node.

15. The pixel according to claim 1, further comprising:

a fourth transistor connected between the first node and initialization power; and a fifth transistor connected between the first power and the third node.

16. The pixel according to claim 15, further comprising:

an eighth transistor connected between the fourth node and the initialization power, wherein a gate electrode of the eighth transistor is connected to the emission control line.

17. The pixel according to claim 1, further comprising:

a fourth transistor connected between the first node and initialization power;

a fifth transistor connected between reference power and the third node; and an eighth transistor connected between the fourth node and the initialization power, wherein a gate electrode of the eighth transistor is connected to the emission control line.

18. A pixel of a display device, the pixel comprising:

a light emitting element;

a first transistor comprising a gate electrode connected to a first node, wherein the first transistor is connected between first power and a second node and controls driving current supplied to the light emitting element;

a second transistor connected between a third node and a data line;

a third transistor connected between the first node and the second node;

a fifth transistor connected between the bias power and the third node;

a sixth transistor connected between the first power and a fifth node connected to one electrode of the first transistor;

a seventh transistor connected between the second node and a fourth node connected to the light emitting element;

a ninth transistor connected between the fifth node and bias power, wherein gate electrodes of each of the sixth transistor, the seventh transistor, and the ninth transistor are connected to a same emission control line.

19. The pixel of claim 18, wherein the third and fifth transistors are controlled by a same scan signal.

20. A pixel of a display device, the pixel comprising:

a light emitting element;

a first transistor comprising a gate electrode connected to a first node, wherein the first transistor is connected between first power and a second node and controls a driving current supplied to the light emitting element;

a second transistor connected between a third node and a data line;

a third transistor connected between the first node and the second node;

a fourth transistor connected between the first node and initialization power;

a sixth transistor connected between the first power and a fifth node connected to one electrode of the first transistor;

a seventh transistor connected between the second node and a fourth node connected to the light emitting element;

an eighth transistor connected between the fourth node and the initialization power; and a ninth transistor connected between the fifth node and bias power, wherein gate electrodes of each of the sixth through ninth transistors are connected to a same emission control line.

21. The pixel of claim 20, wherein the sixth and seventh transistors are transistors of a complementary type different from the eighth and ninth transistors.

* * * * *